US007360724B2

(12) United States Patent
Willey et al.

(10) Patent No.: US 7,360,724 B2
(45) Date of Patent: Apr. 22, 2008

(54) ELECTROSTATIC SPRAY NOZZLE WITH INTERNAL AND EXTERNAL ELECTRODES

(75) Inventors: Alan David Willey, Cincinnati, OH (US); Vladimir Gartstein, Cincinnati, OH (US); Chinto Benjamin Gaw, Cincinnati, OH (US); John Rolland Shaw, Lewis Center, OH (US); William Richard Mueller, Cincinnati, OH (US); Krista Beth Comstock, Mason, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 359 days.

(21) Appl. No.: 10/969,633

(22) Filed: Oct. 20, 2004

(65) Prior Publication Data

US 2006/0081728 A1 Apr. 20, 2006

(51) Int. Cl.
*B05B 5/00* (2006.01)
*B05B 1/14* (2006.01)
*B05B 1/20* (2006.01)

(52) U.S. Cl. ..... 239/707; 239/706; 239/556; 239/557; 239/566

(58) Field of Classification Search ..... 239/707, 239/706, 690, 3, 690.1, 695, 696, 708, 548, 239/550, 556, 557, 566; 118/620, 621, 623–625, 118/627, 629, 313; 427/458, 475, 479; 96/53, 96/75, 76, 83, 84, 222, 240
See application file for complete search history.

(56) References Cited

U.S. PATENT DOCUMENTS

| | | | | |
|---|---|---|---|---|
| 3,941,312 | A * | 3/1976 | Ohno et al. | 239/696 |
| 4,011,991 | A | 3/1977 | Masuda | |
| 4,095,962 | A * | 6/1978 | Richards | 95/65 |
| 4,795,330 | A * | 1/1989 | Noakes et al. | 425/6 |
| 4,854,506 | A | 8/1989 | Noakes et al. | |
| 5,720,436 | A | 2/1998 | Buschor | |
| 5,725,151 | A | 3/1998 | Hetrick et al. | |
| 5,938,126 | A | 8/1999 | Rehman et al. | |
| 6,220,533 | B1 | 4/2001 | Börner et al. | |
| 6,326,062 | B1 | 12/2001 | Noakes et al. | |
| 6,471,753 | B1 * | 10/2002 | Ahn et al. | 96/27 |
| 6,579,574 | B2 * | 6/2003 | Seaver et al. | 427/466 |
| 6,656,253 | B2 | 12/2003 | Willey et al. | |
| 2004/0089156 | A1 | 5/2004 | Gartstein et al. | |
| 2004/0185180 | A1 | 9/2004 | Seaver et al. | |

FOREIGN PATENT DOCUMENTS

| | | |
|---|---|---|
| EP | 0 404 344 A1 | 12/1990 |
| EP | 0 671 980 B1 | 4/1999 |
| EP | 0 752 918 B1 | 6/1999 |

* cited by examiner

OTHER PUBLICATIONS

U.S. Appl. No. 10/969,668, Willey et al., Oct. 20, 2004.

*Primary Examiner*—Kevin Shaver
*Assistant Examiner*—Darren Gorman
(74) *Attorney, Agent, or Firm*—Jay Anthony Krebs; Leonard W. Lewis

(57) ABSTRACT

A nozzle is provided for use in a dynamic electrostatic air filter, in which the nozzle includes an internal electrode that charges a semiconductive liquid, and includes an external electrode that assists in breaking the liquid into droplets in a predetermined direction. Banks of multiple nozzles are also disclosed, which are separated by a charged "separation electrode" to prevent interference with spray patterns between adjacent banks. An electrostatic fountain is also disclosed which discharges a fragrance, or an inhalable medicine.

15 Claims, 15 Drawing Sheets

ELECTROSTATIC SPRAY NOZZLE WITH INTERNAL AND EXTERNAL ELECTRODES

TECHNICAL FIELD

The present invention relates generally to air filtering equipment and is particularly directed to air filters of the type which spray electrostatically charged liquid droplets to collect particulate matter in an air stream. The invention is specifically disclosed as a nozzle for use in a dynamic electrostatic air filter, in which the nozzle includes an internal electrode that charges a semiconductive liquid, and includes an external electrode that assists in breaking the liquid into droplets in a predetermined direction. Banks of multiple nozzles are also disclosed, which are separated by a charged "separation electrode" to prevent interference with spray patterns between adjacent banks. An electrostatic fountain is also disclosed which electrostatically forms a spray of liquid droplets, then discharges the liquid in the form of a fragrance or the like, or an inhalable medicine.

BACKGROUND OF THE INVENTION

Electrostatic spray nozzles are fairly well known in the art, and most of these nozzles are designed to spray paint or some type of solid powder or particles. Some electrostatic spray nozzles are used as fuel injectors for automobile engines. Some spray nozzles are used in pairs to spray two different liquids, thereby intermixing the various liquid droplets within a volume.

U.S. Pat. No. 4,854,506 discloses an electrostatic spraying apparatus that sprays an electrically charged liquid through a nozzle and has a charged electrode mounted adjacent the sprayhead, in which the voltage differential between the charged liquid and the adjacent electrode is sufficient to atomize the liquid. The electrode consists of a core of conducting or semiconducting material, which is covered by a sheath of a "semi-insulating" material, having a dielectric strength and volume resistivity sufficiently high to prevent sparking between the electrode and the sprayhead, and a volume resistivity sufficiently low to allow charge collected on the surface of the sheath material to be conducted through the semi-insulating material to the core. The preferred value for the volume resistivity of the sheathing material is in the range of $5\times10^{11}$ and $5\times10^{12}$ ohm-cms; the dielectric strength is above 15 kV/mm. The charging voltage for the liquid is about 40 kV; the electrode voltage is about 25 kV. If the semi-insulating sheathing material is removed from the electrodes, it is necessary to reduce the differential voltage to about 8 kV, which is accomplished by raising the electrode voltage to about 32 kV. In one embodiment, the sprayhead has linear atomizing edges or slots, and the sprayhead is charged to a voltage in the range of 1-20 kV, and an adjacent electrode is fixed at earth potential. Note that the electrode is still provided with a "semi-insulating" sheath.

U.S. Pat. No. 6,326,062 discloses an electrostatic spraying device that includes a control member that can attenuate the voltage gradient in the vicinity of the spray outlet to such an extent that spraying is suppressed until the device is brought within a predetermined distance of a site to be sprayed. The spray outlet mainly consists of a cartridge that encloses a strip of porous material impregnated with the liquid to be sprayed, which is fed to the tip of a nozzle, using a porous wick-type element that extends into the cartridge to allow liquid to be fed by capillary action to the tip. An annular shroud forms a housing around the tip; the housing is made of insulating material, or a semi-insulating material with a bulk resistivity in the range of $10^{11}$ to $10^{12}$ ohm-cm. The electrical charge on the outer edge of the shroud is of the same polarity as the voltage applied to the liquid emerging from the nozzle tip, and the position of the shroud's outer edge can be varied with respect to the tip of the nozzle. When the shroud approaches an earthed target, some of the potential existing on the shroud is "lost" to earth as a result of corona discharge, which thereby allows the nozzle to commence spraying. Until the shroud is within the critical distance that will induce the corona discharge, the voltage on the shroud will inhibit spraying of the liquid through the nozzle.

U.S. Pat. No. 5,938,126 discloses a powder spray coating system, which has an electrode positioned at the outlet of the nozzle. A controller detects the current to the electrode, and also detects the back current between an ion collector and ground. The controller determines the field strength if the distance changes between the spray gun and the target part that is being coated.

U.S. Pat. No. 5,725,151 discloses a fuel injector that has a "charge injecting electrode" and a "counter electrode." A power supply is connected to both of these electrodes, which act as anode-cathode pair. The power supply imparts a charge in the fuel that is exiting the injector.

U.S. Pat. No. 5,720,436 discloses an electrostatic sprayer with a needle-shaped charging electrode in the air duct near the nozzle's discharge orifice. There is also a set of counter electrodes that remove free ions from the stream of coating material, in which the counter electrodes are upstream from the charging electrode.

Patent document EP 0 752 918 B1 discloses a discharge nozzle in the shape of a capillary tube that outputs a single jet. The tube is charged. A "field guard electrode" is also disclosed that has an adjustable screw that increases or decreases the flow of gas ions to the nozzle that will be sprayed. Another embodiment discloses a "slot nozzle" that is formed between two parallel plates. The output fluid of the slot nozzle exhibits multiple "cusp" and multiple jets, when the voltage and liquid flow rate are properly adjusted.

Patent document EP 0 671 980 B1 discloses some of the same apparatus as in the EP 0 752 918 document described above. Another embodiment is introduced in this '980 document which shows multiple nozzles in a circular pattern. There is also an embodiment that discloses a spray droplet dispenser in which there are two capillary nozzles that each spray liquid droplets toward an intermix space. The liquids being discharged from each of these capillary nozzles are different, and are also charged to opposite polarities. Therefore, these two different liquids will thoroughly intermix within the volume or space.

SUMMARY OF THE INVENTION

It is an advantage of the present invention to provide an electrostatic nozzle apparatus that utilizes both an internal electrode and an external electrode to lower the charging voltage requirements while achieving a suitable nozzle spray pattern.

It is a further advantage of the present invention to provide an electrostatic nozzle apparatus that utilizes both an internal electrode and an external electrode, in which the external electrode is made of an electrically conductive material, or at least its surface is electrically conductive.

It is another advantage of the present invention to provide an electrostatic nozzle apparatus that provides a separation electrode between banks of nozzles, in which the separation electrode allows multiple nozzles to spray suitable spray patterns while reducing the effects of interference that otherwise would exist between the individual nozzle spray patterns without the separation electrode.

It is yet another advantage of the present invention to provide an electrostatic nozzle apparatus that is blade-like and produces a sheet of spray droplets; and which can be combined with a separation electrode between multiple blade-like nozzles to reduce the effects of interference that otherwise would exist between the individual nozzle spray patterns without the separation electrode.

It is still another advantage of the present invention to provide an electrostatic fountain apparatus that emits droplets of a fragrance, or a medicine.

Additional advantages and other novel features of the invention will be set forth in part in the description that follows and in part will become apparent to those skilled in the art upon examination of the following or may be learned with the practice of the invention.

To achieve the foregoing and other advantages, and in accordance with one aspect of the present invention, an electrostatic nozzle apparatus is provided, which comprises: a nozzle having a fluid inlet, a fluid outlet, an internal channel between the fluid inlet and fluid outlet, and an internal electrode that is electrically charged to a predetermined first voltage magnitude, wherein the internal electrode is positioned proximal to the internal channel and imparts an electrical charge to at least a portion of a fluid moving through the internal channel; and an external electrode having a surface that is made of a substantially electrically conductive material, the external electrode being electrically charged to a predetermined second voltage magnitude, wherein the external electrode is positioned at an exit region of the moving fluid as the fluid passes through the fluid outlet.

In accordance with another aspect of the present invention, an electrostatic nozzle apparatus is provided, which comprises: a nozzle having a fluid inlet, a fluid outlet, an internal channel between the fluid inlet and fluid outlet, and an internal electrode that is electrically charged to a predetermined first voltage magnitude, wherein the internal electrode is positioned proximal to the internal channel and imparts an electrical charge to at least a portion of a fluid moving through the internal channel; and an external electrode that is positioned at an exit region of the moving fluid as the fluid passes through the fluid outlet, and which is electrically charged to a predetermined second voltage magnitude, wherein the external electrode's presence enables the nozzle to produce an effective discharge pattern when the predetermined first voltage magnitude is in a range of 2 kV through 39 kV, inclusive, and the predetermined second voltage magnitude is in a range of 1 volt through 31 kV, inclusive.

In accordance with yet another aspect of the present invention, a fluid dispensing apparatus is provided, which comprises: a base structure that exhibits a plurality of protrusions along an upper surface, the base structure being electrically charged to a predetermined first voltage magnitude at locations proximal to at least one of the plurality of protrusions; a layer of fluid that resides on the upper surface of the base structure, wherein at least a portion of the fluid receives an electrical charge therefrom and discharges a stream of fluidic droplets at the locations proximal to at least one of the plurality of protrusions; an external electrode that is electrically charged to a predetermined second voltage magnitude, the external electrode exhibiting a first plurality of openings therein, wherein the external electrode is positioned above the base structure and substantially parallel thereto, and wherein at least one of the first plurality of openings is substantially in registration with a position of the at least one of the plurality of protrusions so that the discharge of fluidic droplets proximal to the at least one of the plurality of protrusions is directed through a corresponding one of the first plurality of openings; a top layer of material which is positioned above the external electrode, thereby forming a volumetric space between the external electrode and the top layer; and a container housing that substantially surrounds the base structure, the layer of fluid, the external electrode, the top layer of solid material, and the volumetric space, wherein the housing exhibits at least one second opening in fluidic communication with the volumetric space; wherein the volumetric space receives the fluidic droplets as a mist which exit from the housing through the at least one second opening.

In accordance with still another aspect of the present invention, an electrostatic nozzle apparatus is provided, which comprises: a first nozzle apparatus having a first fluid inlet, a first fluid outlet, a first internal channel between the first fluid inlet and first fluid outlet, and a first internal electrode that is electrically charged to a predetermined first voltage magnitude, wherein the first internal electrode is positioned proximal to the first internal channel and imparts a first electrical charge to at least a portion of a first fluid moving through the first internal channel; the first nozzle apparatus including a first nozzle body which exhibits a first exterior shape that is substantially longer in a first, longitudinal direction than in a second, transverse direction; the first nozzle apparatus producing a first discharge pattern of the first fluid which exits the first nozzle apparatus at the first fluid outlet, the first discharge pattern exhibiting a first plurality of fluid pathways that are substantially parallel to one another; a second nozzle apparatus having a second fluid inlet, a second fluid outlet, a second internal channel between the second fluid inlet and second fluid outlet, and a second internal electrode that is electrically charged to a predetermined second voltage magnitude, wherein the second internal electrode is positioned proximal to the second internal channel and imparts a second electrical charge to at least a portion of a second fluid moving through the second internal channel; the second nozzle apparatus including a second nozzle body which exhibits a second exterior shape that is substantially longer in a second, longitudinal direction than in a second, transverse direction; the second nozzle apparatus producing a second discharge pattern of the second fluid which exits the second nozzle apparatus at the second fluid outlet, the second discharge pattern exhibiting a second plurality of fluid pathways that are substantially parallel to one another; and a separation electrode physically positioned between both the first nozzle apparatus and the second nozzle apparatus, the separation electrode being electrically charged to a predetermined third voltage magnitude that is lower in magnitude than the predetermined first voltage magnitude and the predetermined second voltage magnitude.

Still other advantages of the present invention will become apparent to those skilled in this art from the following description and drawings wherein there is described and shown a preferred embodiment of this invention in one of the best modes contemplated for carrying out the invention. As will be realized, the invention is capable of other different embodiments, and its several details are capable of modification in various, obvious aspects all without departing from the invention. Accordingly, the drawings and descriptions will be regarded as illustrative in nature and not as restrictive.

BRIEF DESCRIPTION OF THE DRAWINGS

The accompanying drawings incorporated in and forming a part of the specification illustrate several aspects of the present invention, and together with the description and claims serve to explain the principles of the invention. In the drawings:

DETAILED DESCRIPTION OF THE PREFERRED EMBODIMENT

Reference will now be made in detail to the present preferred embodiment of the invention, an example of which is illustrated in the accompanying drawings, wherein like numerals indicate the same elements throughout the views.

Figure 1:
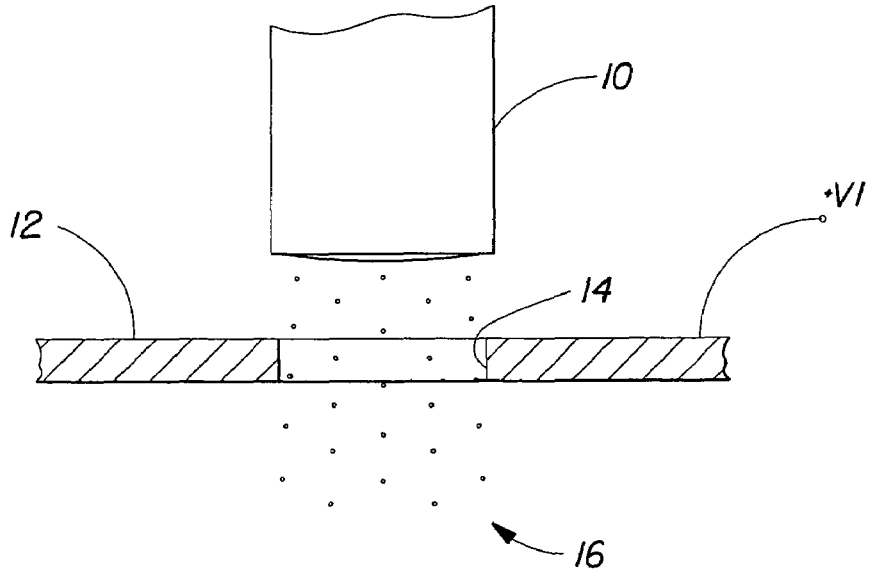
FIG. 1 is a side or elevational view of a spray nozzle having an external electrode, as constructed according to the principles of the present invention.

Referring now to FIG. 1, a single nozzle, generally designated by the reference numeral 10, is illustrated as producing a series of liquid droplets 16, and which is used in conjunction with an electrically charged atomizing external electrode 12 that is separate from the nozzle body 10. External electrode 12 has an opening at 14, through which the liquid droplets 16 will flow. In addition, the external electrode 12 generally is charged to a voltage that is designated +V1. One main purpose of providing the external electrode is to produce an effective discharge pattern by the liquid droplets 16.

Figure 2:
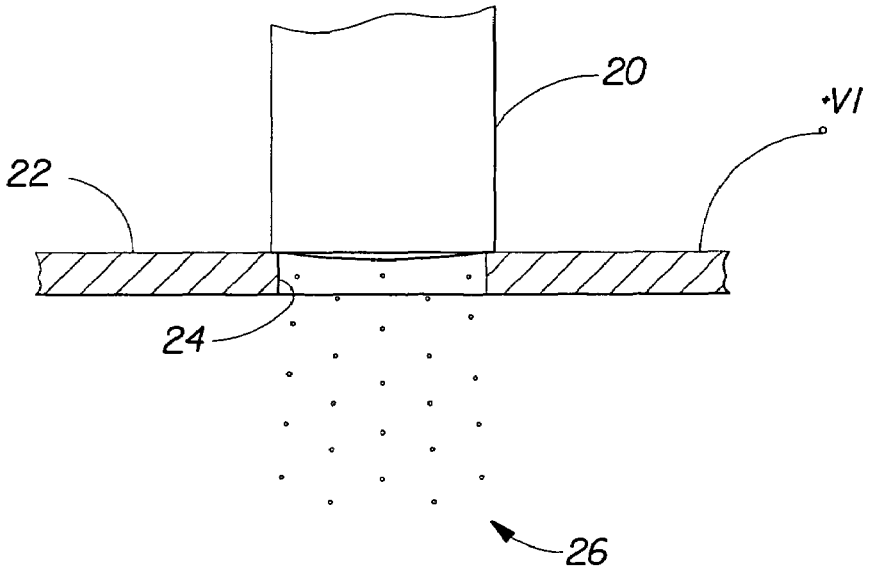
FIG. 2 is a side or elevational view of another spray nozzle that has an external electrode, in which the external electrode is attached to the discharge end of the nozzle, as constructed according to the principles of the present invention.

FIG. 2 illustrates an alternative arrangement, in which a nozzle body 20 dispenses a series of liquid droplets at 26. However, in this arrangement, an external electrode 22 is not separated from the nozzle body, and instead is attached at the discharging end of the nozzle body. The external electrode 22 also exhibits an opening 24, which is just large enough in its inner diameter to fit over the discharging end of the nozzle body 20. This electrode 22 generally is charged to a voltage +V1.

Figure 3:
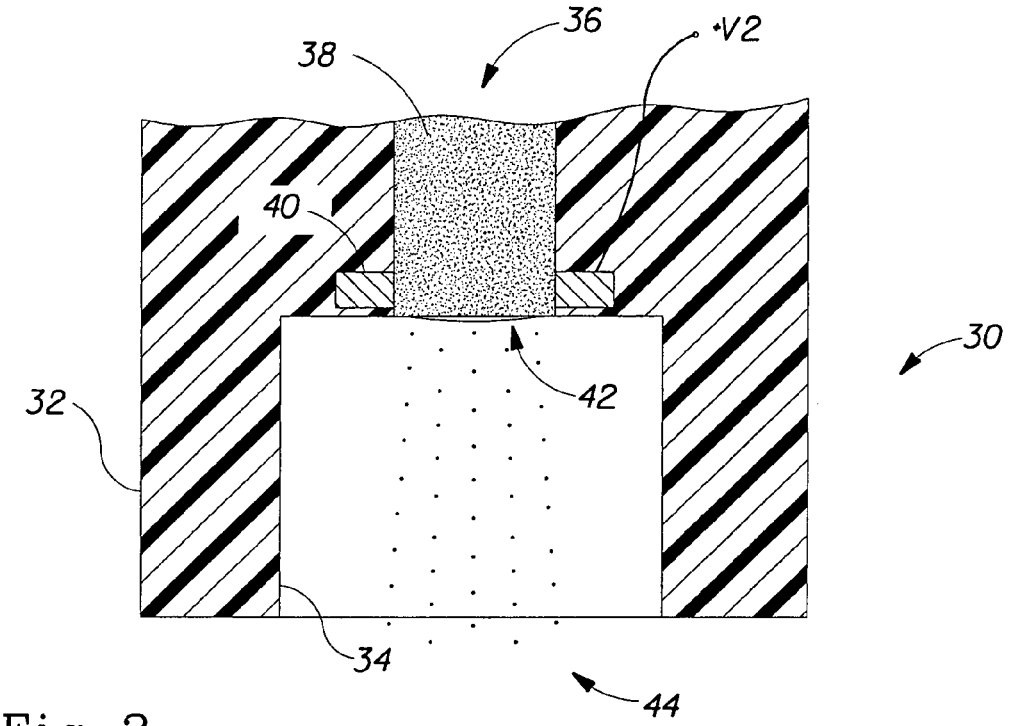
FIG. 3 is a side or elevational view in partial cut-away, showing a spray nozzle with an internal electrode, as constructed according to the principles of the present invention.

Referring now to FIG. 3, some of the internal construction of one of the nozzles is illustrated, in which the nozzle is generally designated by the reference numeral 30. Nozzle 30 preferably is made of plastic or some other electrically insulative material, which has an outer surface or wall at 32, and an inner surface or wall at 34 that forms an interior region or interior volume. The nozzle 30 also includes an internal channel 36, through which a liquid flows, as indicated at 38. An internal charging electrode 40 is located at the discharging end of this channel 36, and the electrical charge that is applied to this electrode 40 is sufficient to break the liquid at 38 into droplets, which occurs at a "boundary" generally designated by the reference numeral 42. The droplets themselves are designated at 44. The internal electrode 40 preferably is made of an electrically conductive, or an electrically semiconductive, material and is charged to a voltage, as designated by the +V2 on FIG. 3. One preferred embodiment uses a cylindrical shape for the nozzle 30, in which the outer wall 32 is essentially an outer circular diameter, while the inner wall 34 is also of a circular shape (having an inner diameter).

Figure 4:
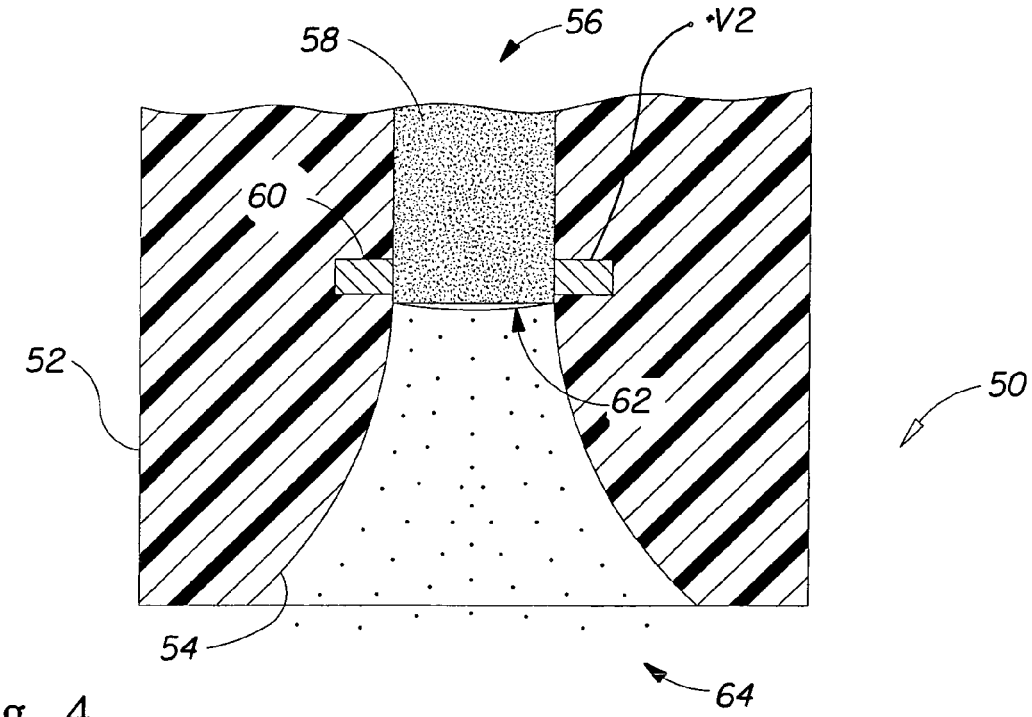
FIG. 4 is another spray nozzle in a side or elevational view in partial cross-section, having an internal electrode and having a different geometry for the exit for the discharge, as according to the present invention.

FIG. 4 illustrates an alternative construction and depicts some of the interior construction details, in which the nozzle is generally designated by the reference numeral 50. Nozzle 50 also includes an outer wall or surface 52, and an inner wall or surface 54 that forms an interior region or interior volume. In this instance, the inner wall 54 is not of a generally cylindrical shape, but instead has a generally parabolic shape (as seen in this view). There also exists an internal channel at 56 through which a liquid flows as illustrated at 58. An internal atomizing electrode is provided at 60, which is charged to a voltage +V2. The liquid 58 is then charged sufficiently so that it breaks apart into droplets, which occurs at a "boundary" 62 near the internal electrode 60. The liquid droplets themselves are indicated by the reference numeral 64. Internal electrode 60 preferably is made of an electrically conductive, or an electrically semi-conductive, material.

Figure 5:
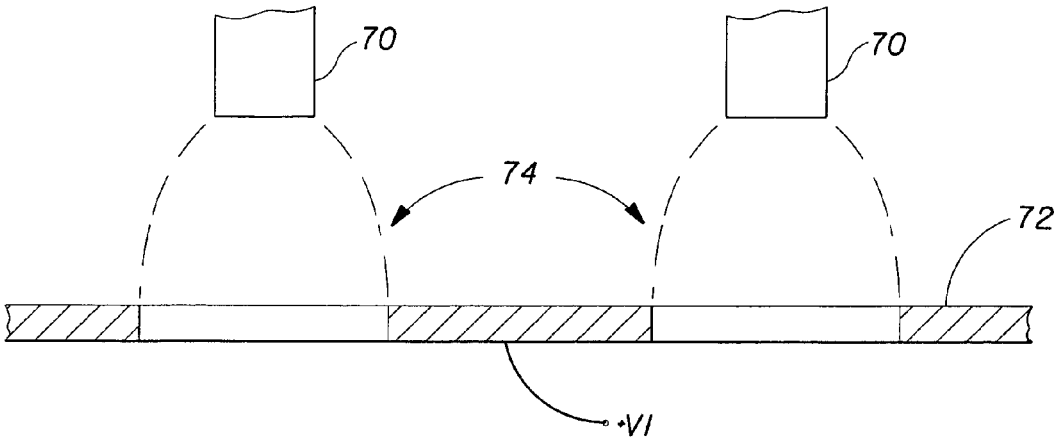
FIG. 5 is a side or elevational view of a pair of nozzles with an external electrode plate, forming an electric field therebetween.

Referring now to FIG. 5, a pair of nozzles, each generally designated by the reference numeral 70, are illustrated as being located proximal to a separate external electrode 72. The nozzles 70 can be of any general type, including the nozzles 10, 20, 30, or 50 which are illustrated in FIGS. 1-4. The external electrode 72 is in the form of a substantially planar plate that has two openings in this view, such that each nozzle 70 is located proximal to, and in registration with, one of these openings. Electrode plate 72 is also charged to a high voltage, as indicated at +V1. The electric field between the nozzle bodies 70 and the charged electrode plate 72 is indicated by the lines 74 on FIG. 5. Note that +V1 could represent a negative voltage.

Figure 6:
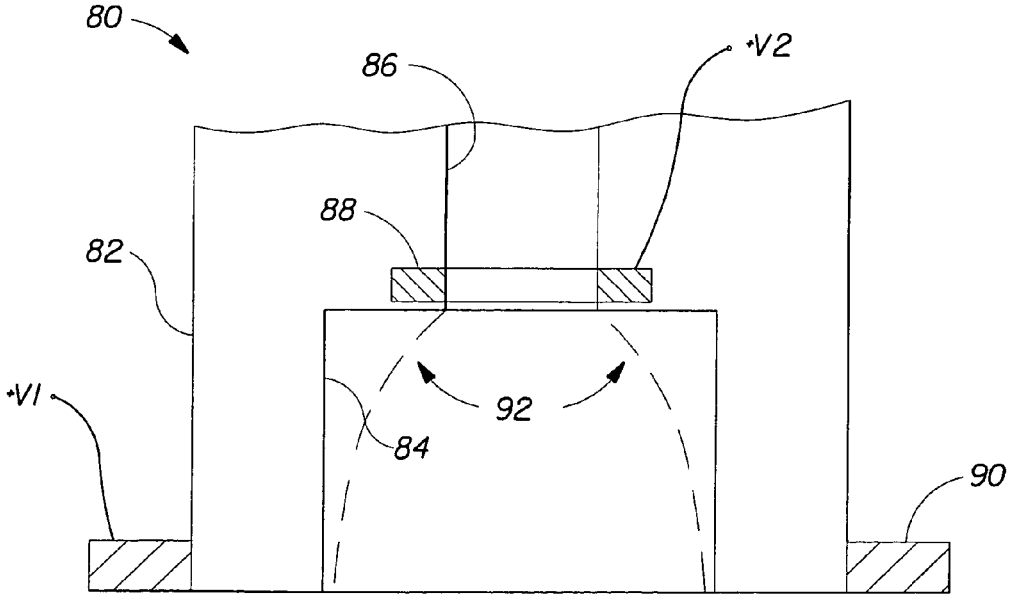
FIG. 6 is a side or elevational view in partial cross-section of a nozzle having an internal electrode and an external electrode, showing an electric field formed therebetween.

Referring now to FIG. 6, a nozzle body is generally designated by the reference numeral 80, and combines the construction details of the nozzle body 30 of FIG. 3 with the external electrode 22 of FIG. 2. In FIG. 6, the exterior wall of the nozzle body is indicated at 82, and the exterior electrode is designated at the reference numeral 90. This external electrode 90 generally is charged to a voltage +V1. The interior wall of the nozzle is indicated at 84, and the interior channel of the nozzle is indicated at 86. There also is an internal electrode at 88, which will be charged to a voltage +V2. The electric field produced by the internal electrode 88 is indicated by the field lines 92. It should be noted that the voltage of the external electrode 90 also comes into play with regard to producing the electric field lines 92.

One of the benefits of the present invention is to provide an external electrode that will help to both atomize and direct the spray of liquid droplets that emanate from the nozzle, while at the same time lowering the overall voltage needed to be induced on the internal electrode. Moreover, the use of the external electrode will also allow for a closer spacing between two adjacent nozzles. With regard to the spacing of the components illustrated in FIG. 1, for example, the linear distance between the discharging end of the nozzle body 10 and the separate external electrode 12 could be in the range of 5-15 mm, and for many applications should probably be less than 2 cm. Of course, in the embodiment of FIG. 2, there is no deliberate spacing between the external electrode 22 and the discharge end of the nozzle 20.

In general, when using an external electrode, an array of multiple nozzles will successfully operate at the same voltage levels as would be used with a single nozzle. This is in reference to both the external electrode voltage (+V1) and the internal electrode voltage (+V2). The interior shape of the outlet passageway may affect the charging voltages, but they would still be at reduced magnitudes as compared to a nozzle with only an internal charging electrode and no external charging electrode.

It will be understood that the words "charging" and "atomizing" (referring to an electrode) can be interchanged for most purposes with regard to the present invention. In all circumstances, the internal electrode will tend to break the liquid into droplets, and the external electrode will tend to assist in guiding those droplets toward a predetermined target area or volume. It will also be understood that the charging voltages can be of equal magnitude, different magnitudes, and negative (or positive) voltages if desired, without departing from the principles of the present invention. In general, however, if the internal electrode voltage is of one polarity, then the external electrode will also exhibit the same polarity. Otherwise, the liquid droplets would tend to be directly attracted to the external electrode, instead of passing through an opening in the external electrode. This is not an absolute requirement, however; there may be configurations in which the polarities are opposite, and nevertheless work well. For purposes of the present invention, the term "internal electrode" will apply to the electrode that is within the interior space of the nozzle body, while the term "external electrode" will apply to the electrode or electrode plate that is positioned external to the nozzle body, although the external electrode may or may not be spaced apart from the nozzle body itself.

Figure 7:
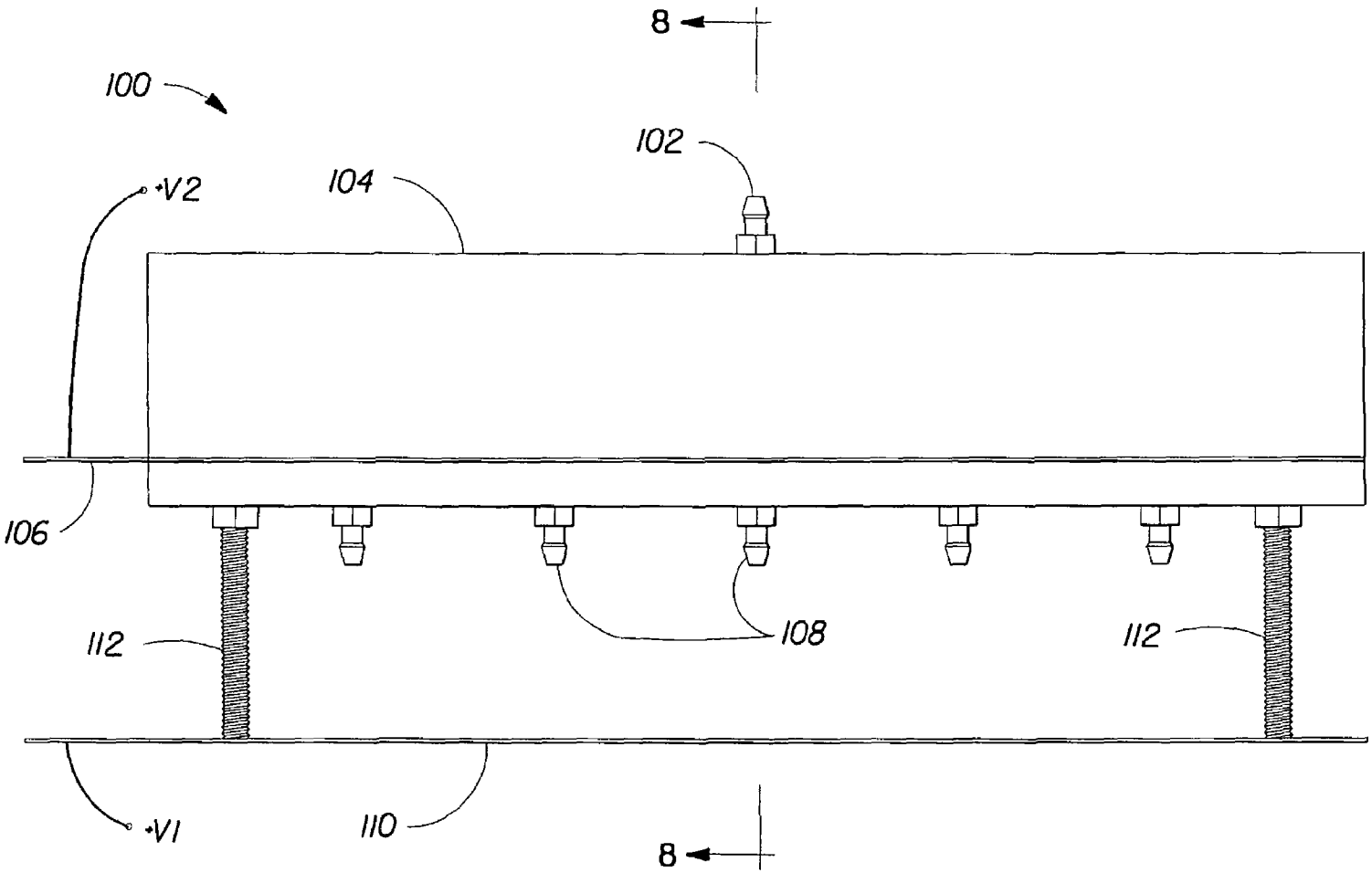
FIG. 7 is a side or elevational view of a multiple nozzle assembly, in which the multiple nozzles are arranged in a linear manner, as constructed according to the principles of the present invention.

Referring now to FIG. 7, an apparatus generally designated by the reference numeral 100 is illustrated that includes multiple nozzles 108, which in this example apparatus are lined up in a row. Nozzles 108 can be virtually any type, size, and construction that allows a liquid to be electrostatically charged and then dispersed through the outlet of the nozzle. This includes the nozzles illustrated in FIGS. 1-6.

An inlet port 102 is located at the top of the apparatus 100 in FIG. 7. The liquid flows through the inlet port 102, through a distribution manifold 104, and then through individual passageway (not seen in this view) to each of the outlet nozzles 108. An internal electrode 106 is electrically charged to a voltage +V2, and this internal electrode 106 runs through the distribution manifold such that it is placed in close proximity to each of the internal passageways through which the liquid flows from the inlet port 102 to each of the outlet nozzles 108. By this method, the liquid flowing therethrough will be charged by that voltage +V2.

In FIG. 7, a "bottom" plate 110 acts as an external electrode, which generally is charged to a voltage +V1. A pair of rods 112 are used to properly space-apart the distribution manifold assembly from the external electrode 110. Of course, the rods 112 can be made to any desired distance, which can be very small, if desired. In a preferred mode of the invention, the external electrode 110 will have multiple openings therein, through which liquid droplets will be sprayed from the outlet of each of the nozzles 108. This is better seen in FIG. 10, discussed below.

Figure 8:
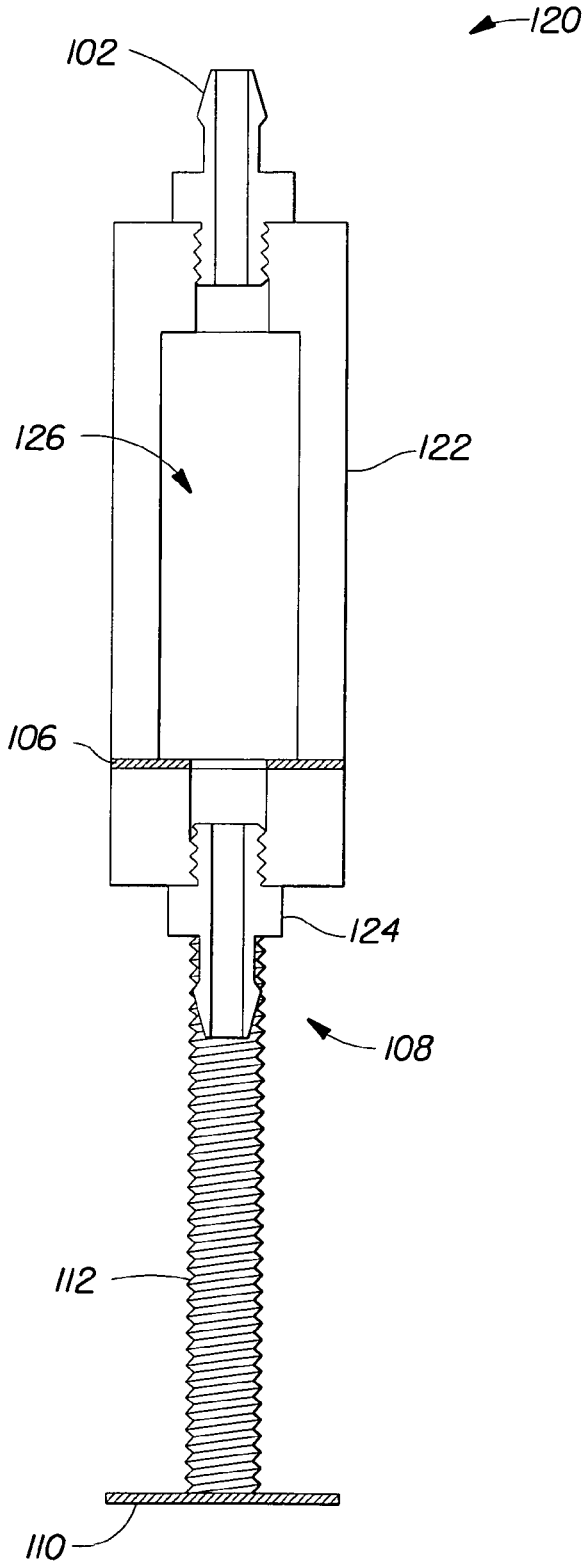
FIG. 8 is an end view in partial cross-section of one of the nozzles of the apparatus of FIG. 7, taken along the line 8-8 of FIG. 7.

Referring now to FIG. 8, a cross-section through one of the nozzles 108 and the distribution manifold and inlet port, is illustrated, and this portion of the apparatus 100 is generally designated by the reference numeral 120. The liquid will flow through inlet port 102 into a chamber 126, where it travels past the internal electrode 106, in which this internal electrode has an opening through which the liquid can flow while it is being charged to the electrostatic potential +V2. The "nozzle body" around the inlet 102, chamber 126, and outlet nozzle 108 is generally designated by the reference numeral 122. The outlet nozzle 108 is held in place by some type of mechanical fastener, such as a hexagonal nut at 124. The rod 112 and external electrode 110 are also seen in this view of FIG. 8.

Figure 9:
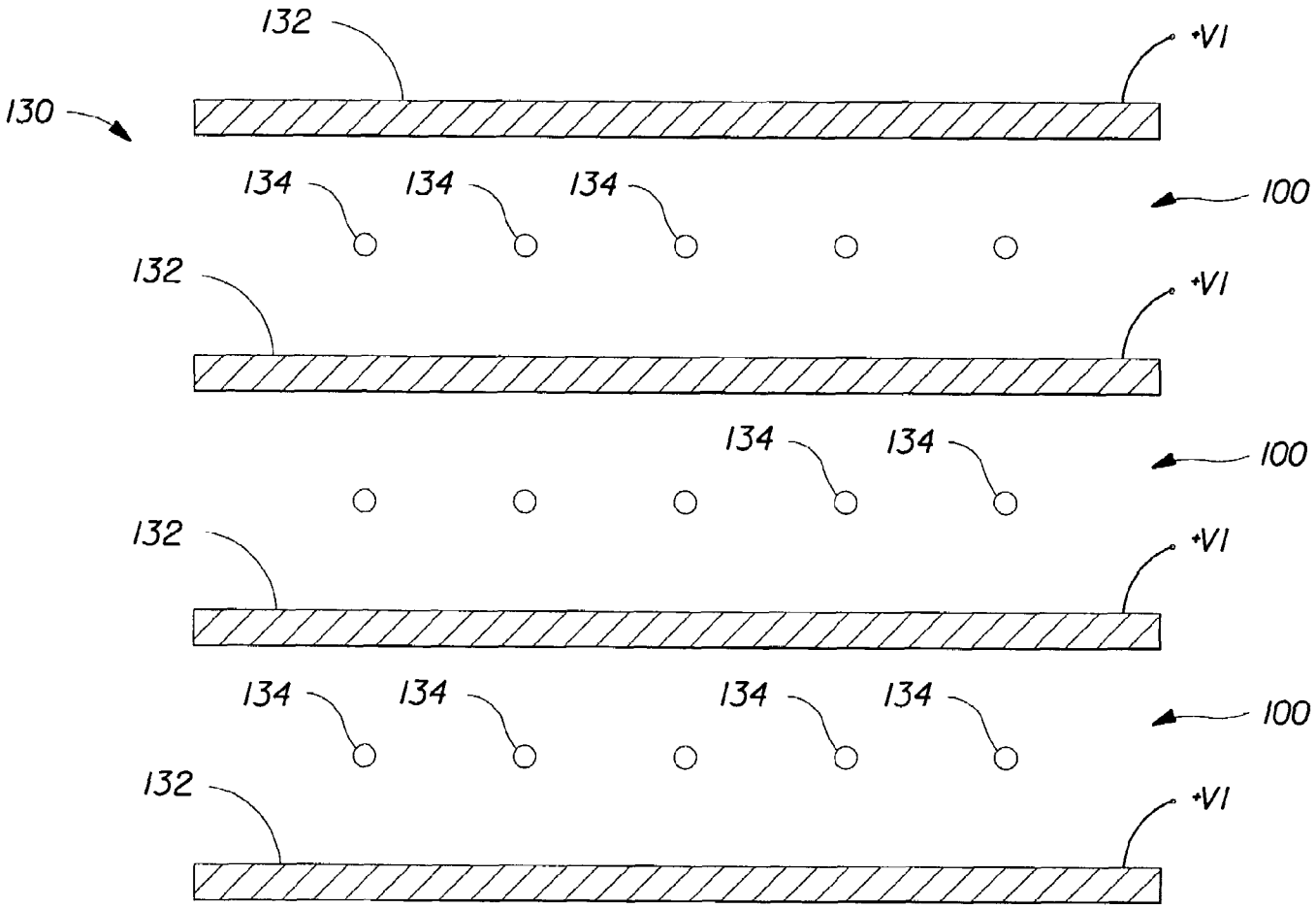
FIG. 9 is a top view of a schematic diagram illustrating three banks of five in-line nozzles each, with separation or "bar" electrodes, as constructed according to the principles of the present invention.

Referring now to FIG. 9, a set of multiple nozzles is illustrated in schematic form, in which there are four nozzles in a row, which form a "bank" of nozzles 100. In addition, there are separation electrodes 132, shaped like "longitudinal" or "bar" electrodes between each "bank" of these nozzles. The overall apparatus is designated by the reference numeral 130. Each separation/bar electrode 132 generally is charged to a voltage +V1. This is representative of an "external" electrode, although in this case, the separation/bar electrodes 132 do not necessarily have openings through which the liquid droplets pass therethrough. Instead, these separation electrodes are designed to improve efficiency and uniformity in spray pattern and amount of spray that will be possible to eject or disperse through the individual nozzles 134, without having to greatly increase the applied electrostatic voltage used to initially charge the liquid passing through each nozzle. However, it should be noted that separation electrodes 132 need not consist of solid "bars" of material—instead, they could be formed of a screen or mesh material, or even of a grill pattern of metal, for example. It will be understood that the separation electrodes for all embodiments could be made from an electrically conductive material or from certain semiconductive materials, or it could be made of a non-conductive material so long as its surface areas were substantially electrically conductive or semiconductive.

Each of the nozzle "banks" is essentially equivalent to one of the in-line banks of nozzles 100 that is illustrated in FIG. 7. Of course, the physical sizes and shapes of such a bank of in-line nozzles could be significantly different from that illustrated in FIGS. 7 and 8, while still being applicable to the schematic arrangement illustrated in FIG. 9, without departing from the principles of the present invention.

As will be discussed in more detail below, the use of the external electrode 110 (as seen in FIG. 7) tends to reduce the magnitude required for the internal charging voltage of one of the nozzles 108. At the same time, the separation/bar electrodes 132 that isolate one bank of nozzles from another also tends to reduce the overall charging voltage magnitude needed to provide a sufficient spray pattern and flow of liquid droplets. It will be understood that, without the separation electrodes 132, the nozzles 134 would have to be spaced quite far apart from one another to avoid interfering with each other, especially with regard to the higher electrostatic potential that would have to be applied to the liquid as it is sprayed through each of the nozzles. This is one of the important principles of the present invention: to improve efficiency and uniformity of the nozzle spray pattern, while also reducing the magnitude of the voltage used for charging the spray droplets while achieving a desired spray pattern, and also reducing the voltage applied to the external electrodes themselves.

With regard to the center-to-center spacing between the nozzles 134 in FIG. 9, the minimum such spacing is approximately 5 mm, and the dimension between the outer diameters of two adjacent nozzles in that situation is about 0.76 mm for an exemplary nozzle design. This is very close indeed as compared to a spacing of center-to-center of about one inch (25 mm) that would otherwise be needed if the external electrode was not used. These dimensions are based upon experimental results, and are indicative of the benefits of the present invention. The actual dimensions for various different liquids that are being charged and sprayed through nozzles would, of course, be different depending upon the dielectric characteristics of the liquid, which would relate to the magnitudes of the charging voltages internal to the nozzles, as well as the voltages of the external electrodes.

Figure 10:
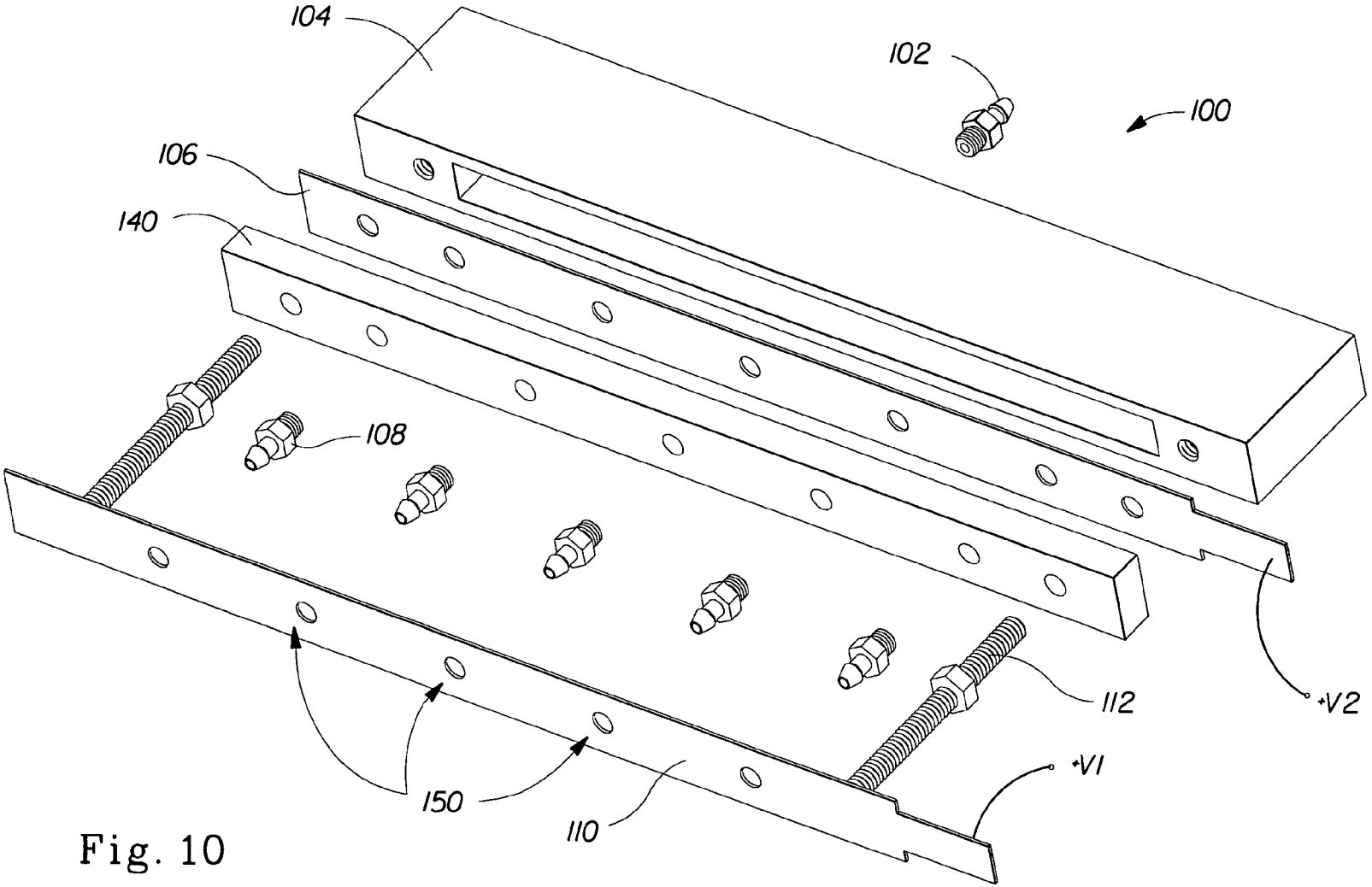
FIG. 10 is a partially exploded perspective view of the multiple in-line nozzle apparatus of FIG. 7.

Referring now to FIG. 10, the five-nozzle distribution apparatus 100 is illustrated in a perspective view, which illustrates the inlet 102, manifold 104, internal charging electrode plate 106, multiple outlet nozzles 108, external electrode 110, and support rods 112. A base structure at 140 is also better illustrated on FIG. 10, which in this construction, separates from the manifold portion 104, thereby allowing access for assembly or for cleaning (if desired) of the internal electrode 106. Also, the openings in the external electrode 110 are visible in FIG. 10, and these openings are generally designated by the reference numeral 150. The locations of openings 150 generally should be in registration with the positions of the nozzles 108. Note that the nozzle assembly 100 may not spray vertically downward as illustrated in FIG. 7, but could be mounted at any desired angle, including straight up, or horizontally.

Figure 11:
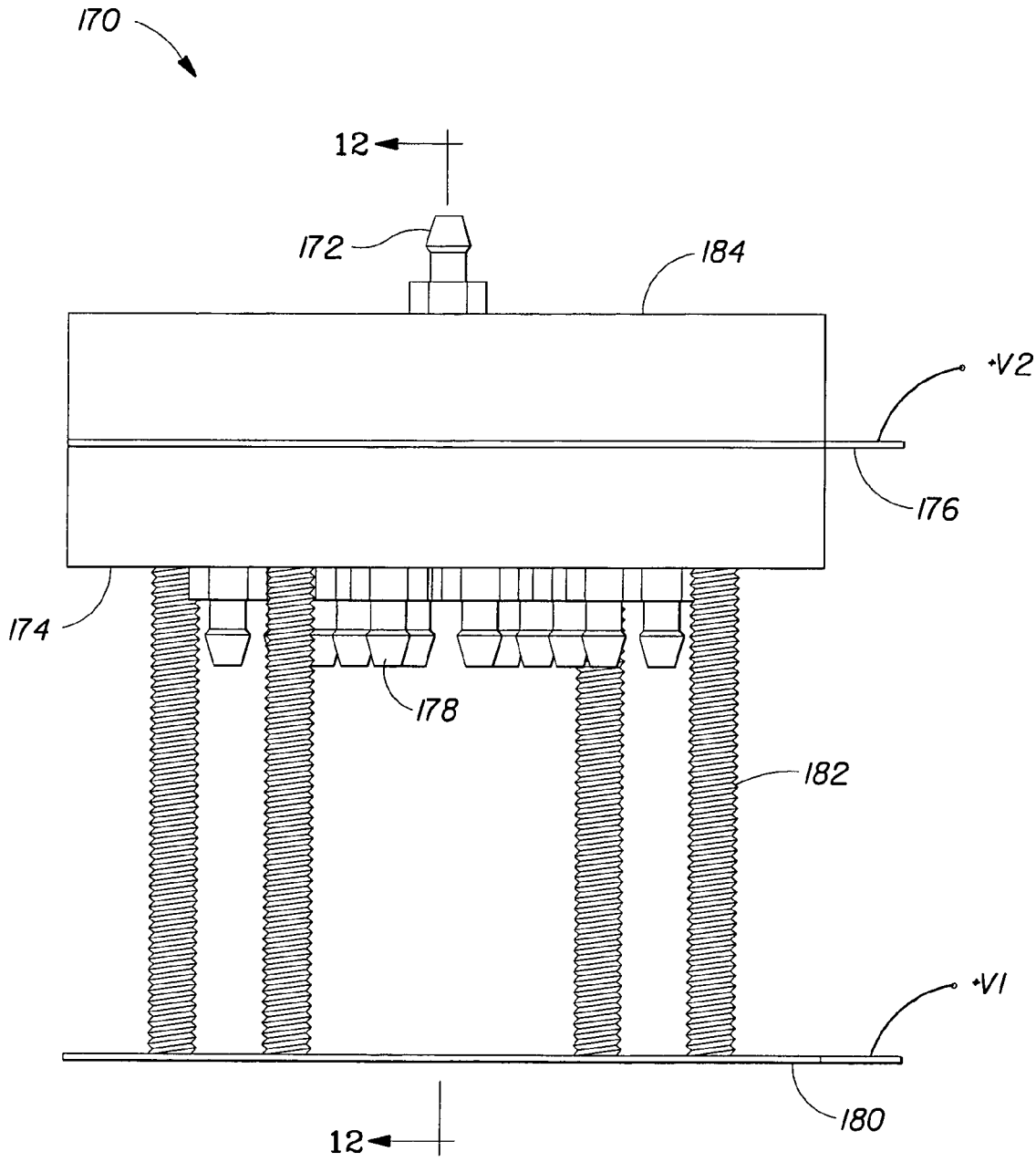
FIG. 11 is a side or elevational view of a multiple nozzle assembly that contains both an internal electrode and an external electrode, as constructed according to the principles of the present invention.

Referring now to FIG. 11, another multiple nozzle apparatus is illustrated, generally designated by the reference numeral 170. In this apparatus, there are several nozzles 178 that are formed in a non-linear manner, so that the nozzles are in a pattern that is not explicitly in-line (in contrast to the multiple nozzle assembly 100 of FIGS. 7-10). An inlet port 172 is the receptacle for receiving a fluid (e.g., a liquid), which passes through a manifold portion 184 until reaching individual passageways (not shown on FIG. 11). An internal electrode 176 is also illustrated, and this separates the manifold portion 184 from a base portion 174 of the main nozzle-holding structure. The passageways to each nozzle can split off above the internal electrode 176, if desired, or there can be a common passageway and reservoir or chamber (as seen in the cut-away view of FIG. 12), leading to individual passageways to the individual nozzles, if desired.

An external electrode is also included at 180, and support rods or posts 182 separate the bottom portion of the base 174 from the external electrode 180. The external electrode 180 generally will be charged to a voltage +V1. Note that the nozzle assembly 170 may not spray vertically downward as illustrated in FIG. 11, but could be mounted at any desired angle, including straight up, or horizontally.

Figure 12:
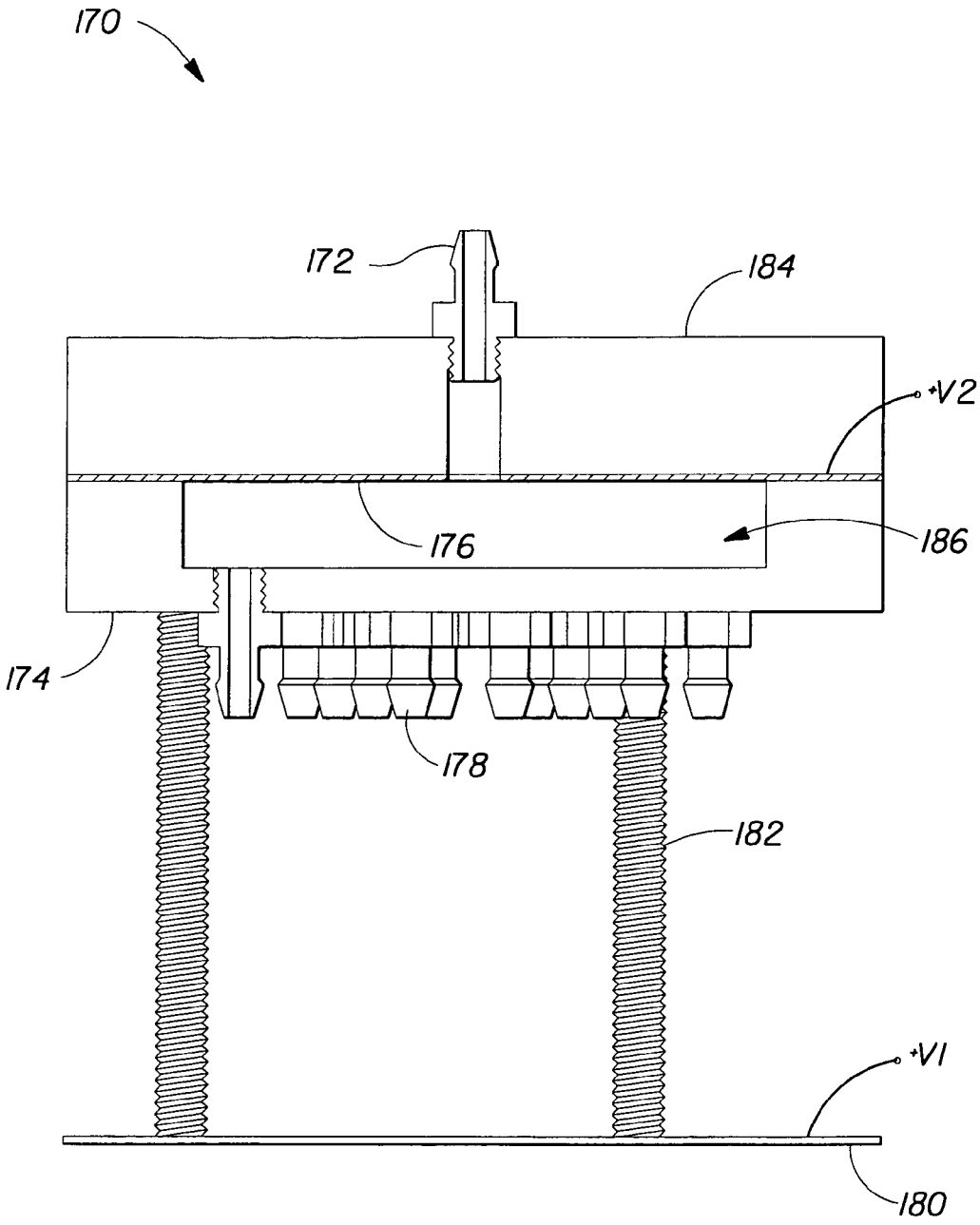
FIG. 12 is another side view in partial cross-section of the apparatus of FIG. 11, taken along the line 12-12 of FIG. 11.

FIG. 12 shows the multiple nozzle apparatus 170 in a partial cut-away view, and shows an internal reservoir 186 that receives the liquid after it has been charged by the internal electrode 176. The charged liquid will now be directed through passageways to the individual nozzles 178, where it is discharged and becomes sprayed as liquid droplets. There can be openings in the external electrode 180 to help to direct the liquid spray droplets. External electrode 180 will also reduce the overall magnitude of the charging voltage required to achieve a predetermined (and probably substantially uniform) spray pattern.

Figure 13:
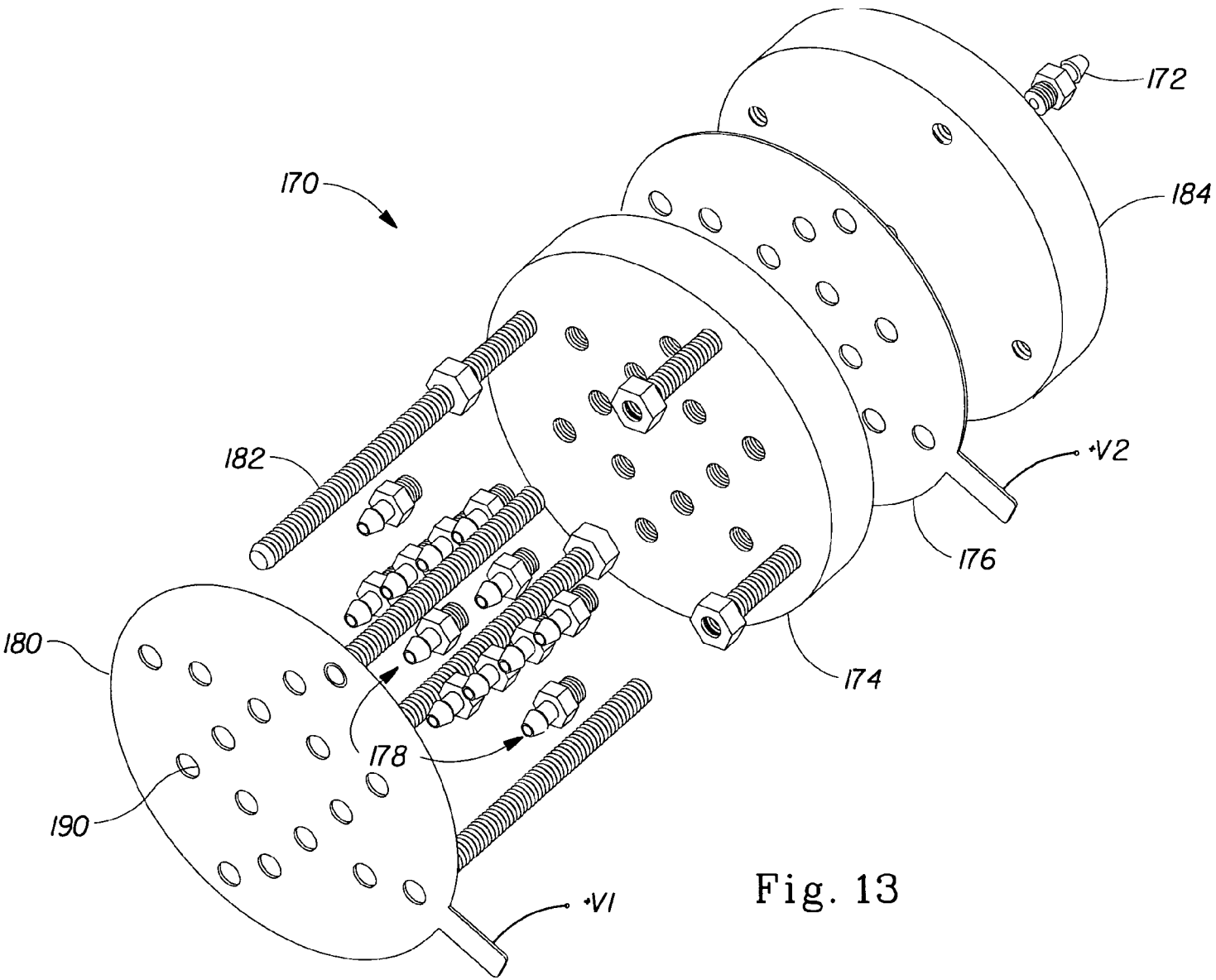
FIG. 13 is a partially exploded perspective view of the apparatus of FIG. 11.

Referring now to FIG. 13, the multiple nozzle apparatus 170 is illustrated in a perspective view, which illustrates the "top" inlet port 172, the manifold portion 184, the base portion 174, the internal electrode 176, multiple outlet discharge nozzles 178, a set of rods or spacers 182, and the external electrode 180. In addition to the above, the openings 190 in the external electrode 180 are visible in this view of FIG. 13. It will be understood that the hole pattern of these openings 190 can be significantly altered, as well as the locations of the nozzles 178, without departing from the principles of the present invention. It will also be understood that the arrangement of the reservoir 186 and the liquid passageways within the manifold 184 and base 174 can be significantly different from that illustrated in FIG. 12, without departing from the principles of the present invention. However, the locations of openings 190 generally should be in registration with the positions of nozzles 178.

Figure 14:
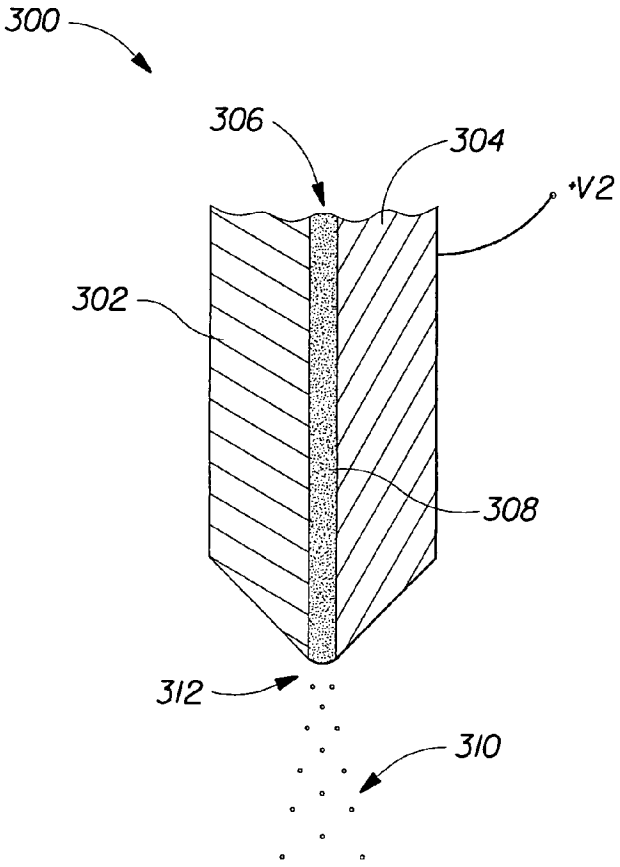
FIG. 14 is an end view of the "tip" portion of a blade nozzle that is constructed according to the principles of the present invention.

Referring now to FIG. 14, a parallel plate "blade nozzle" generally designated by the reference numeral 300 is illustrated. The two parallel plates are designated at 302 and 304, and these plates are spaced-apart a small distance to create a slot-type passageway 306 through which a liquid at 308 will flow. The plates will preferably be charged to a voltage +V2 as indicated on FIG. 14, so that the liquid 308 also becomes charged before it reaches the exit point where the liquid erupts into individual spray droplets 310. This exit point (or "exit termination region") is indicated at the reference numeral 312, which forms near the physical "tip" of the two plate-like blades 302 and 304. A meniscus that protrudes somewhat from the tip of these plates may be formed. This meniscus could be either convex or concave, depending upon the charging voltage +V2 and the dielectric characteristics of the liquid 308. Of course, this can be prearranged by the designer of the apparatus. The relatively "narrow" width of nozzle 300 will also be referred to herein as in a "transverse" direction. Its perpendicular dimension is much greater, and will be referred to herein as in a "longitudinal" direction.

Figure 15:
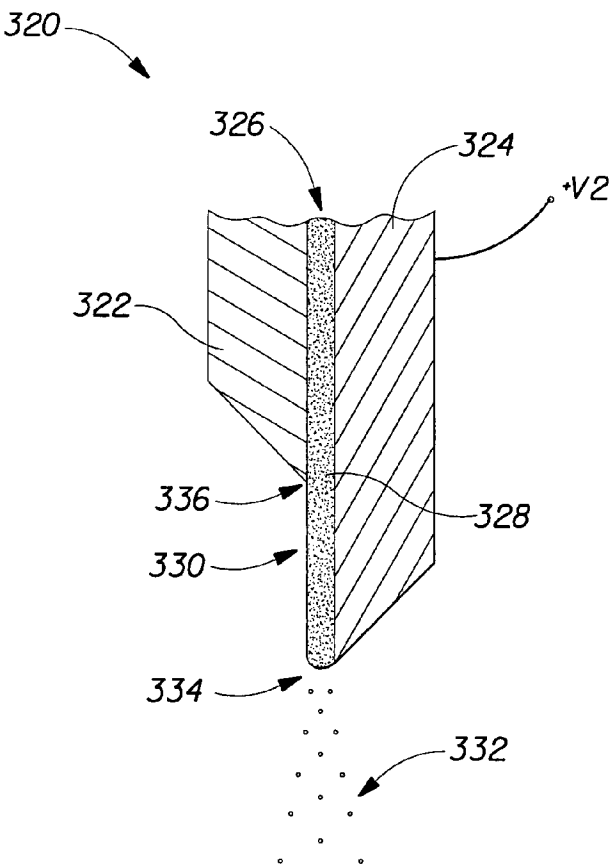
FIG. 15 is an end view of a blade nozzle in which one of the blades protrudes further than the other blade, as constructed according to the principles of the present invention.

Referring now to FIG. 15, an alternative arrangement of a "blade nozzle" is illustrated, generally designated by the reference numeral 320. Two parallel plates are again used at 322 and 324, however, one of the parallel plates (i.e., plate 324) protrudes a short distance further in the downward direction (as viewed on FIG. 15) from the "tip" of the plate 322. There is again a slot-type passageway at 326 formed between the two plates 322 and 324 by arranging them in a parallel, spaced-apart relationship. The plates preferably are charged to a voltage +V2, which means that the liquid 328 flowing through the passageway or slot 326 will be charged before reaching the exit point of the blades.

As can be seen on FIG. 15, the liquid does not immediately erupt into droplets upon reaching the bottommost tip or line (a "first termination line") 336 of the left-hand plate (as seen in FIG. 15) 322, but continues to run down the surface of the more extending plate 324, at the location indicated by the reference numeral 330. When the liquid 330 reaches the bottommost tip or line (as seen on FIG. 15) of the plate 324, it will then erupt into individual liquid droplets 332. This eruption occurs at the area designated by the reference numeral 334 (which is a "second termination line"). The actual points (or lines) where the liquid erupts into tiny droplets will be determined by the charging voltage +V2, as well as by the dielectric characteristics of the liquid 328 and the flow rate of this liquid flowing through the passageway 326.

Figure 16:
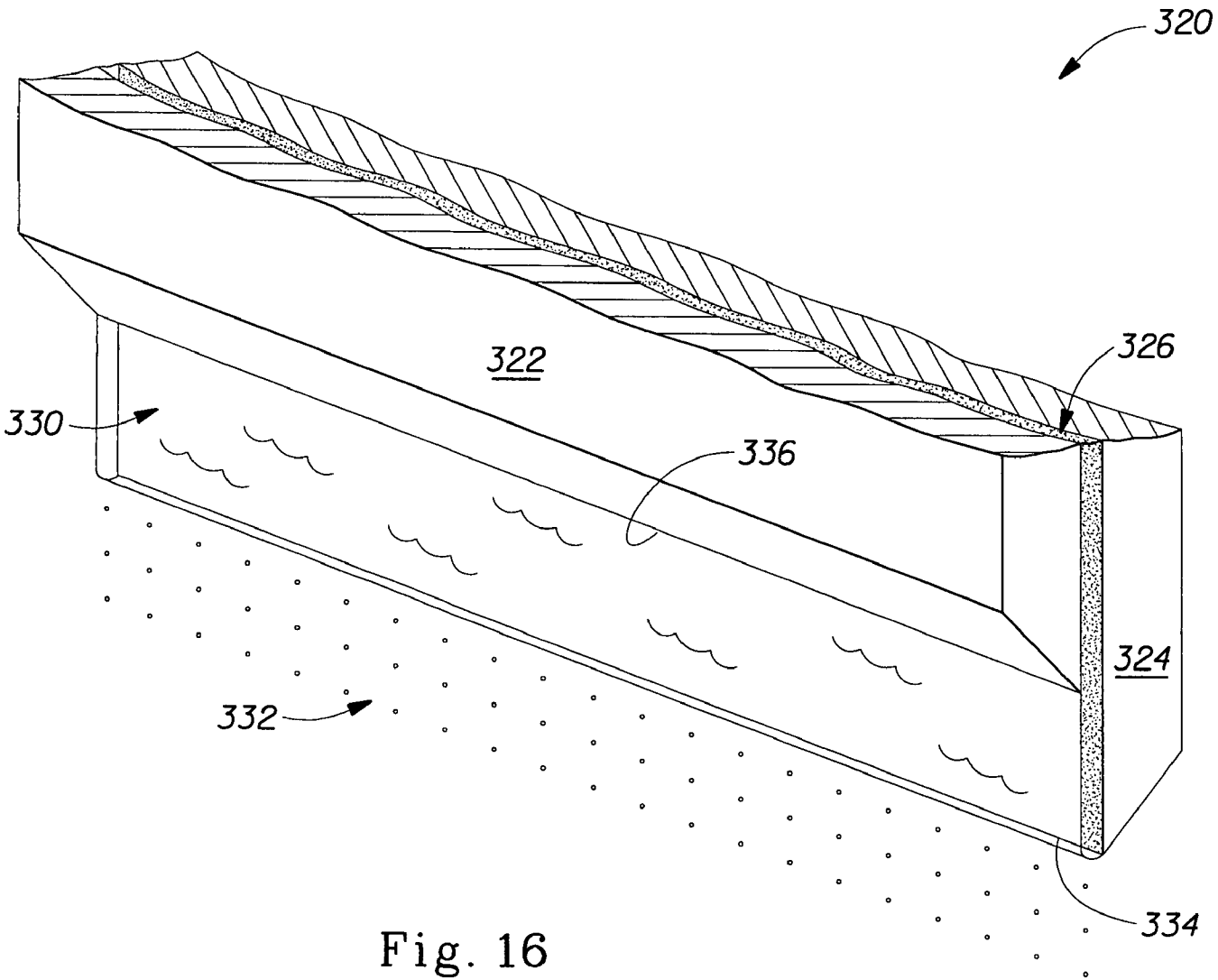
FIG. 16 is a perspective view of the blade nozzle of FIG. 15.

FIG. 16 shows some of the construction details and flow pattern details of the apparatus of FIG. 13 in a perspective view, which more clearly shows the flow of the liquid 330 as it runs down the surface of the blade 324. As can be seen, the liquid droplets will create a "sheet" of spray droplets at 332, because of the geometry of the blades 324 and 322 (i.e., in that they are elongated as viewed from the side, which can be better seen in FIG. 16). The relatively "narrow" width of nozzle 320 will also be referred to herein as in a "transverse" direction. Its perpendicular dimension is much greater, and will be referred to herein as in a "longitudinal" direction.

It should be noted that the materials used for the blades 302 and 304 in FIG. 14, and the blades 322 and 324 in FIGS. 15-16 typically are electrically conductive. Alternatively, the surfaces only of the blades could be electrically conductive, or at least the interior surfaces that form the slots or passageways 306 and 326 for the blade nozzles 300 and 320, respectively.

Figure 17:
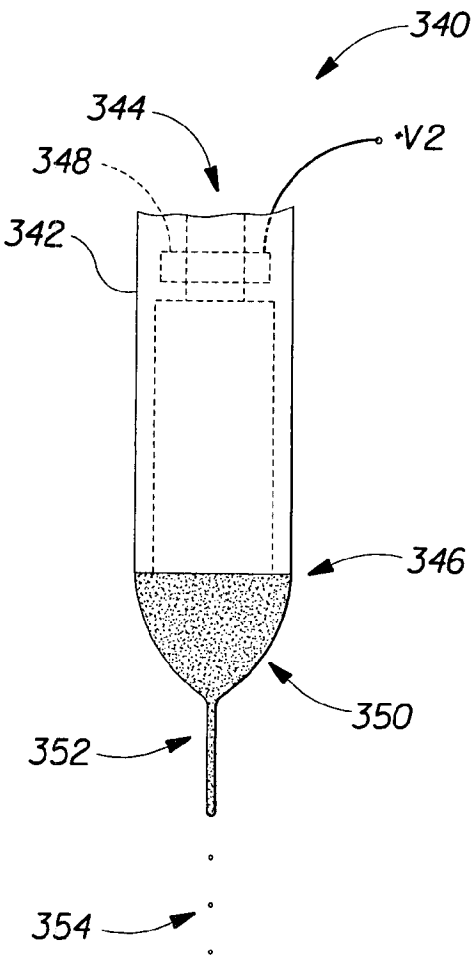
FIG. 17 is an end view of a knife-edge nozzle that is constructed according to the principles of the present invention.

Referring now to FIG. 17, an alternative nozzle design is illustrated from its end, in which the nozzle has the form of a "knife-edge," meaning that the nozzle is fairly long and thin. In FIG. 17, this knife-edge nozzle is generally designated by the reference numeral 340, and has an exterior side wall at 342, with an interior passageway 344 through which a liquid will flow. The bottom portion of the nozzle is indicated at 346, and a meniscus or cusp will form at 350 under the proper operating conditions (as discussed below) at an "exit region" proximal to this bottom portion 346.

The nozzle body 342 includes an interior passageway 344, as noted above, which will then spread out into a larger internal area after the liquid passes an internal electrode 348 that is charged to a voltage +V2. As the charged liquid reaches the outlet of the knife-edge nozzle at 346, and forms the meniscus 350, the flow of liquid will narrow to a ligament at 352, and will finally erupt into a series of individual liquid droplets at 354.

Figure 18:
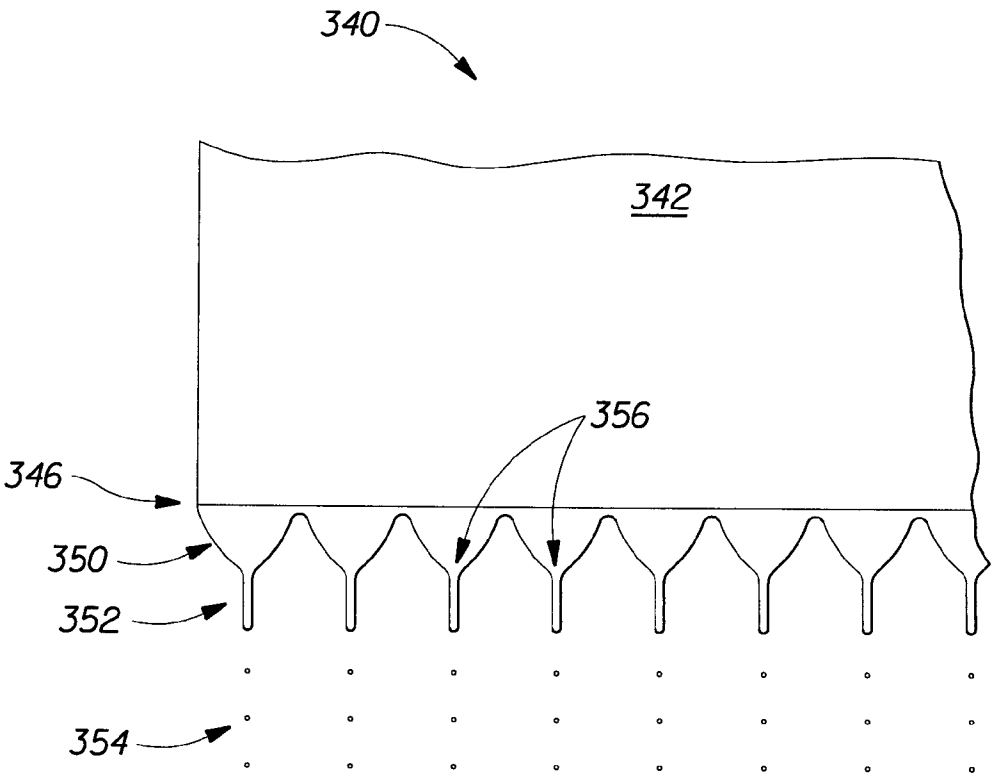
FIG. 18 is a side view of the knife-edge nozzle of FIG. 17.

FIG. 18 illustrates the same apparatus 340 in a side view, which shows the fairly long dimension (i.e., in a longitudinal direction) of the knife-edge nozzle as compared to the fairly narrow dimension (i.e., in a transverse direction) that was depicted in the end view of FIG. 17. In FIG. 18, the outer surface 342 is seen as extending down to the bottom edge at 346 of the nozzle apparatus itself. What appeared to be a single meniscus or cusp 350 can now be more clearly illustrated as being multiple such cusps on FIG. 18, each of which contains a small pocket of liquid at 356. Each of these cusps 350 forms a separate ligament 352, which later breaks up into a separate stream of droplets at 354. In this manner, a "sheet" of liquid droplets is formed, similar in shape to the sheet of liquid droplets 332 that were formed by the blade nozzle of FIG. 16.

Figure 19:
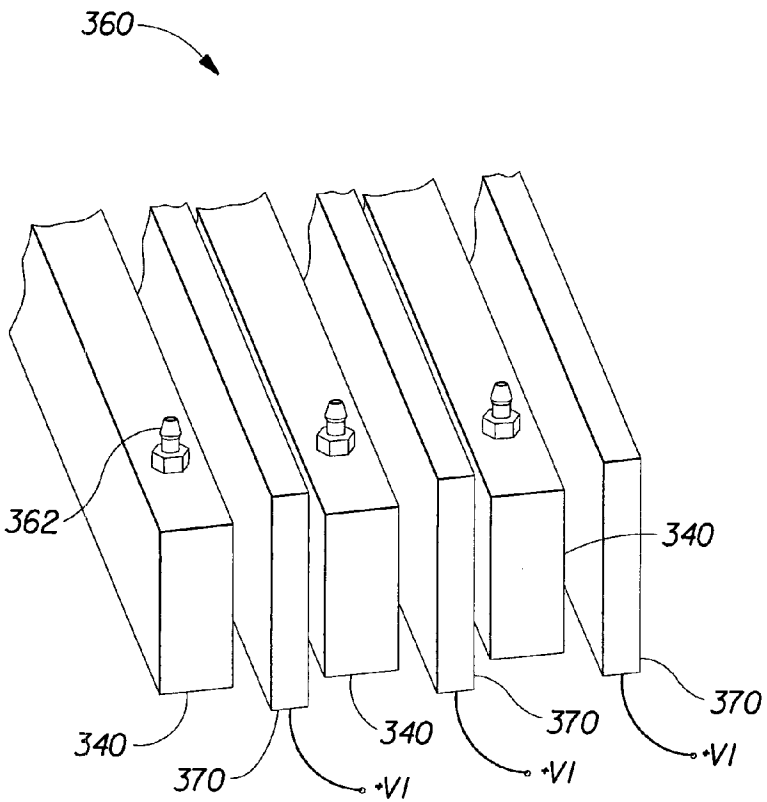
FIG. 19 is a perspective view of multiple knife-edge nozzles of FIG. 17, separated by a longitudinal bar (separation) electrode.

Referring now to FIG. 19, an arrangement of multiple knife-edge nozzles 340 is illustrated, in which each knife-edge nozzle 340 is separated by a charged separation electrode 370, shaped like a "longitudinal" or "bar" electrode. Each knife-edge nozzle 340 has a "top" inlet port 362, although the word "top" is only descriptive of the orientation illustrated on FIG. 19. It will be understood that the nozzle structures 340 could be aimed at any angular direction desired by the system designer.

The individual separation electrodes 370 are each charged to a voltage +V1, and these separation electrodes allow the multiple knife-edge nozzles 340 to be spaced relatively close to one another without a massive interference pattern forming between the outlet sprays of each of the knife-edge nozzles 340. If not for the separation electrodes 370, the individual spray patterns of each knife-edge nozzle 340 would more likely interfere with one another, and secondly, they would probably have to be spread further apart from one another for that very reason. It will be understood that the longitudinal or "bar" (separation) electrodes could comprise a screen or mesh material, a grill structure, or a solid bar of material, or yet some other equivalent structure.

Figure 20:
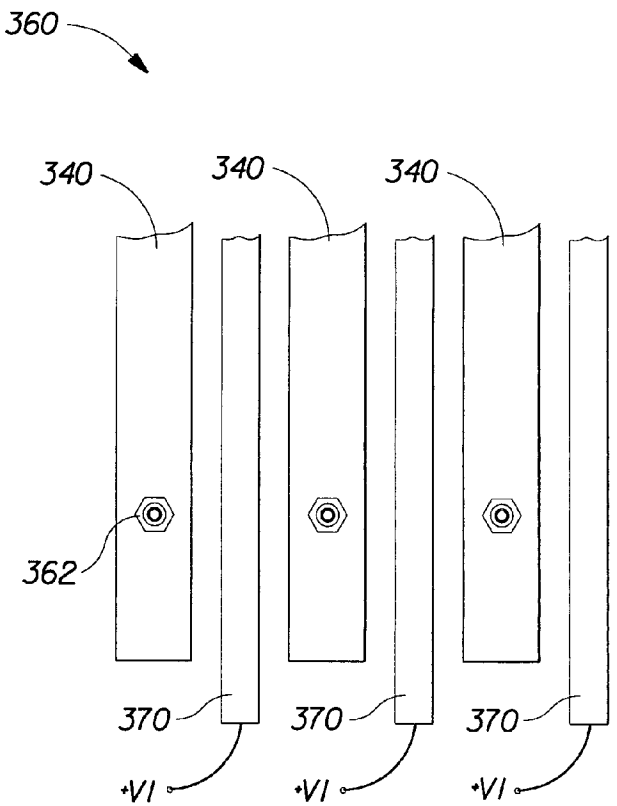
FIG. 20 is a top view of the multiple knife-edge nozzles and separation electrodes of FIG. 19.

The overall arrangement of the multiple knife-edge nozzles 340 and separation electrodes 370 is generally designated by the reference numeral 360. The same multiple nozzle apparatus 360 is also illustrated in FIG. 20 in a top view, which clearly shows the spaced-apart relationship between the knife-edge nozzles 340 and the separation electrodes 370.

The material used to make the knife-edge nozzle 340 could be an electrically insulative material, such as plastic or glass. The charging electrode 348 would typically be made of an electrically conductive material, or of a semiconductive material that can be charged to a relatively high potential.

One advantage of the knife-edge nozzle 340 is that it forms a "full area" spray pattern fairly quickly, because the spacing between the individual ligaments 352 can be closer to one another than spacing between individual nozzles, such as the nozzles 108 of FIG. 7. This "full area spray pattern" concept would also be substantially fulfilled by the blade nozzles illustrated in FIGS. 14-16.

Figure 21:
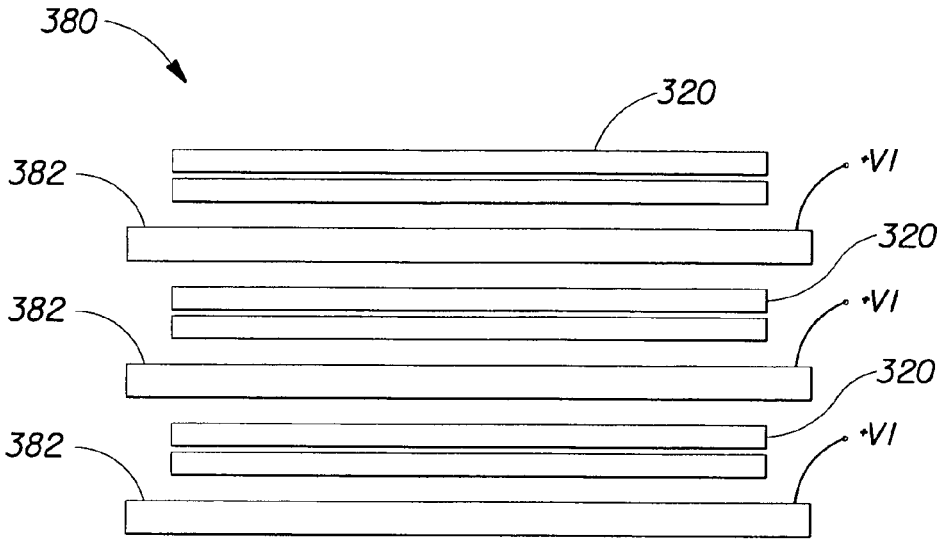
FIG. 21 is a bottom view of multiple blade nozzles of FIG. 15, separated by longitudinal bar electrodes.

Referring now to FIG. 21, the blade nozzles 300 and 320 can also be arranged in multiple units, and in the case of FIG. 21, a multiple blade nozzle apparatus is generally designated by the reference numeral 380. Each of the blade nozzles is of the type 320 illustrated in FIG. 15, and each of these nozzles 320 is separated by a separation electrode 382, which is charged to a voltage +V1. The addition of the separation electrodes 382 (shaped like a longitudinal "bar") allows multiple blade nozzles 320 to be arranged relatively in close proximity to one another, without terribly disrupting their spray patterns. This allows for a more uniform spray pattern and a closer spacing of the multiple nozzles 320. It will be understood that the longitudinal or "bar" (separation) electrodes could comprise a screen or mesh material, a grill structure, or a solid bar of material, or yet some other equivalent structure.

Figure 22:
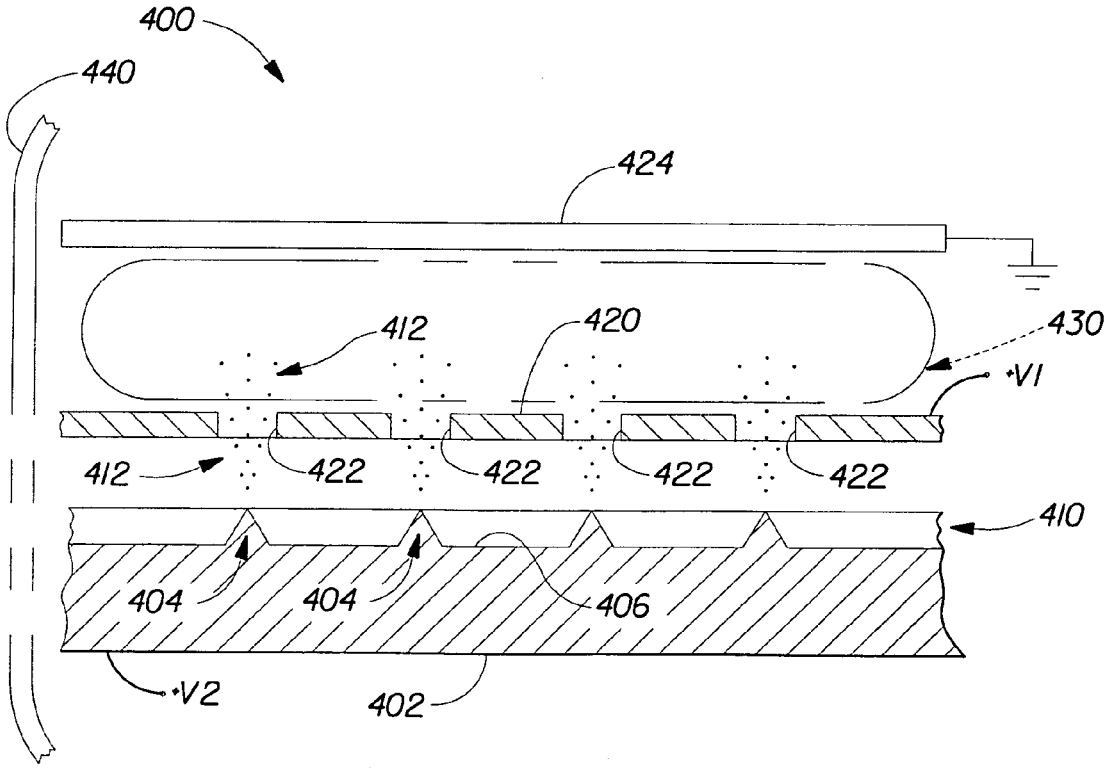
FIG. 22 is a side or elevational view in partial cross-section of an electrostatic fountain, as constructed according to the principles of the present invention.

Referring now to FIG. 22, an apparatus generally designated by the reference numeral 400 is illustrated that emits streams of liquid or fluidic droplets in an upward direction (as seen on FIG. 22) which can be used to dispense perfume or other odorants, or it can be used as a nebulizer for persons who are required to intake medication by inhaling. The "bottom" portion of the apparatus is located at 402, which has a top structure that is substantially planar for the most part, but also has protrusions at 404 that will have an effect on a layer of liquid (or other fluid) at 410 that is placed (or resides) on top of the upper surface 406. It is preferred that at least portions of the "bottom" member 402 be charged to a voltage +V2, so that the liquid 410 will tend to "erupt" into droplets at the upper points 404 of these protrusions. Of course, the liquid 410 must have the proper dielectric characteristics for this to occur. It should be noted that the "upper points" 404 could actually be in the form of multiple ridges (perhaps parallel, or in an X-Y grid pattern), or could consist of "peaks" of pyramids, needle-like members, or other cylindrical members.

An upper atomizing electrode 420 is provided, which is charged to a voltage +V1 and acts as an "external electrode" in the same sense as other external electrodes that have been described above. In FIG. 22, the external electrode 420 contains several openings at 422, through which the spray droplets at 412 will pass toward a grounded plate 424. It is preferred that the locations of the openings 422 be substantially in registration with the positions of the upper points 404.

The volume or space (a "volumetric space") between the external electrode 420 and the grounded plate 424 is generally designated by the reference numeral 430. Within this volume 430, the liquid droplets can become a fine mist that will either spray through fine openings in the grounded plate 424, or can be "blown" out from the space 430 by a fan, electrical charge, or by some other type of electropneumatic methodology or apparatus, through openings in a housing wall 440 that contains the entire "electrostatic fountain" 400.

The overall effect of the apparatus 400 is that it acts as an electrostatic fountain, which can fill a small room with a fragrance, a perfume, a deodorizer, or some type of partially charged particles, if desired. It can also be used as a nebulizer, as noted above, which can fill a small room with a medicine needed by a patient who desires to inhale the small liquid droplets as a fine mist.

With regard to electrical charging voltages, the nozzle designs of FIGS. 1-4 will typically work well when the charging voltage +V2 is in the range of 5 kV through 15 kV, and when the atomizing or external electrode is charged to a voltage +V1 in the range of zero (0) through 5 kV. (It could be grounded in some applications.) For certain semiconductive fluids that are used to create the tiny liquid droplets, an exemplary set of charging voltages is +10 kV for the internal electrode at +V2, and at +3 kV for the external electrode at +V1.

The nozzles of the present invention can be used at even lower charging voltages, perhaps as low as 2 kV absolute magnitude for V2 (used with the internal electrode). The nozzles of the present invention can also be used at even greater charging voltages, such as at least 39 kV absolute magnitude for V2 (used with the internal electrode), or such as at least 31 kV absolute magnitude for V1 (used with the external electrode). Note that negative polarity voltages may be used for V1 and V2.

It was not discussed above in detail, but in many applications using the present invention, the sprayed liquid droplets will be directed into a space or volume where "dirty" air is directed, such that the spray droplets will accumulate dust and other particles or particulates. The individual droplets will then continue to a collecting surface or collecting plate, that is typically fixed at ground potential. This type of design has been described as an overall air cleaning apparatus in earlier patent applications by the same inventors, which are commonly assigned to The Procter & Gamble Company. Examples of these earlier patent applications are: U.S. patent application Ser. No. 10/282,586, filed on Oct. 29, 2002, titled DYNAMIC ELECTROSTATIC FILTER APPARATUS FOR PURIFYING AIR USING ELECTRICALLY CHARGED LIQUID DROPLETS; and U.S. Provisional patent application Ser. No. 60/422,345, filed on Oct. 30, 2002, titled DYNAMIC ELECTROSTATIC AEROSOL COLLECTION APPARATUS FOR COLLECTING AND SAMPLING AIRBORNE PARTICULATE MATTER.

As noted above, the fluids used in the present invention may be used for cleaning air, and the overall apparatus that performs that function is sometimes referred to as an electrohydrodynamic air cleaner. An optimized electrohydrodynamic (EHD) spray will mainly consist of uniform droplet sizes with a high charge-to-mass ratio, which is capable of removing other particulate matter from the airflow. It is generally desired to generate a charged cloud of droplets capable of collecting airborne particulate matter, and the some of the important properties of the droplets for optimizing such particulate collection include the surface tension, conductivity, and dielectric constant. The types of fluids that are suitable for use in the present invention, or in many types of EHD air cleaners, are described in a co-pending patent application by some of the same inventors, which is commonly assigned to The Procter & Gamble Company. This application is U.S. patent application Ser. No. 10/697,229, filed on Oct. 30, 2003, titled Dynamic Electrostatic Aerosol Collection Apparatus For Collecting And Sampling Airborne Particulate Matter, which claims benefit of U.S. Provisional patent application Ser. No. 60/422,345, filed Oct. 30, 2002.

Another invention by some of the same inventors provides a spray nozzle head that exhibits multiple outlet ports that tend to more uniformly distribute the high potential electric field at the tips of these multiple outlet ports. This invention is described in a co-pending patent application that is commonly assigned to The Procter & Gamble Company, under U.S. patent application Ser. No.10/969,668, filed on Oct. 20, 2004, titled ELECTROSTATIC SPRAY NOZZLE WITH MULTIPLE OUTLETS AT VARYING LENGTHS FROM TARGET SURFACE.

It will be understood that the design of the present invention will work well at other voltage ranges, including higher voltage ranges, which may even be preferable for certain types of liquids being used to create the charged droplets, and also at increased flow rates if desired for certain applications. For air cleaning applications, the droplet size and droplet density are usually of significance to the overall particle "cleaning efficiency," and these parameters are often affected by the charging voltage.

It will also be understood that the internal electrodes for all embodiments could be made from an electrically conductive material or from certain semiconductive materials. The internal electrodes must be capable of accepting an electrical charge and passing that charge to the fluid by contact with the surface of the internal electrodes.

It will be further understood that the external electrodes for all embodiments could be made from virtually any electrically conductive material, including a conductive metal such as copper or aluminum, or perhaps stainless steel (which is somewhat less conductive). In addition, the external electrodes could have a substantially conductive surface, such that the electrical charge is distributed over the outer surface of the electrodes. For example, the external electrodes could be made of a metallized plastic material, in which a plastic material (which typically is substantially non-conductive) is plated with a thin layer of metal. Alternatively, the external electrodes could be made of a conductive plastic material, such as a plastic filled with carbon. Also, the external electrodes could be made of a metal-filled plastic material, such as polyethylene or polypropylene filled with metal particles, such as aluminum or copper; or a fine stainless steel wire mesh that is filled with a plastic material could be used. For some applications, the external electrodes could perhaps be made of certain semiconductive materials.

With regard to the nozzles of FIGS. 1-4, if the atomizing (or external) electrode is not used, then the charging voltage for the internal electrode (at +V2) would typically have to dramatically increase, perhaps into the range of approximately 40 kV. It can be easily seen that the external electrode has an immediate benefit by reducing the magnitude of the charging voltage for the internal electrode. It should be noted that the present invention could indeed be used with a charging voltage of at least 40 kV for the internal electrode, if desired. The external electrode could also have its charging voltage increased, for example up to 32 kV or greater. However, the greater the voltage magnitudes for these two electrodes, the greater the power consumption in a typical installation, and also the greater the possibility of accidental or intermittent electrical discharge between the two electrodes, or between either one of the electrodes and another surface, including a grounded surface. The high-voltage power supply output voltages that charge the electrodes can be selected by a system designer as needed for a particular commercial application, and many combinations of charging voltage magnitudes can be used within the principles of the present invention, and are contemplated by the inventors.

With regard to some of the other designs or embodiments described above, in which multiple nozzles are used with bar or plate electrodes separating groups of such nozzles, these separation electrodes will typically allow the spray pattern of the multiple nozzles to remain more uniform with less interaction therebetween. This is also true for the elongated nozzles that are referred to above as "blade" nozzles or "knife-edge" nozzles, which can be spaced much closer to one another because of the separation electrodes.

In most applications involving the spray nozzles of the present invention, there will be a "chamber" (i.e., some type of predetermined volume) that "receives" the spray droplets that are emitted by the nozzles. In general, this chamber will include a "target surface" against which these spray droplets will impact. In situations where the overall spraying apparatus acts as an air cleaner (e.g., by removing particulates from a stream of gas flowing through the chamber), the target surface typically will be such that the spray droplets will aggregate into a liquid, either directly on the target surface itself, or the droplets will be directed (via gravity, for example) toward a separate collecting member of the overall spraying apparatus. While such a target will most likely comprise a solid surface, there may be applications where a solid target surface is not desired. In that circumstance, such target surface could then consist of a mesh or a screen member, or if desired, it could appear solid but exhibit a high porosity characteristic.

It will be understood that the above target surface could be either charged to a predetermined voltage, or could be effectively held to ground potential. For safety reasons, it might be better to tie the target surface directly to ground, via a grounding strap or a ground plane, for example. However, in some circumstances, perhaps an improved spraying pattern or an improved collection efficiency may be obtained by applying a voltage to this target surface. In many cases, such an applied potential would be at a lower absolute magnitude than the voltage (absolute magnitude) applied to either the internal or external electrodes, but this certainly is not a necessary restriction.

In some cases, the potential applied to the target surface may well be at the opposite polarity to the voltage applied to the spray droplet charging electrode. In this circumstance, the charged spray droplets would thereby become directly attracted (via electrostatic charge) to the charged target surface, which may increase collection efficiency of the spray fluid. It will be understood, however, that for air cleaners, one of the most important attributes typically will be the collection efficiency of the particles in the air stream, and the voltage potential of the target surface (grounded or not) could impact that characteristic. The physical configuration of one possible spraying apparatus of the present invention can be quite different compared to another configuration (including air flow rates, charged droplet spraying rates, expected pressure drop through the air cleaner apparatus, air temperature and humidity, etc.), and the optimum voltage potential of the target surface should be evaluated for each such configuration.

All documents cited in the Detailed Description of the Invention are, in relevant part, incorporated herein by reference; the citation of any document is not to be construed as an admission that it is prior art with respect to the present invention.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. An electrostatic nozzle apparatus, comprising:

(a) a first plurality of nozzles physically arranged in a first bank of nozzles;

(b) a second plurality of nozzles physically arranged in a second bank of nozzles; each nozzle in said first plurality of nozzles and said second plurality of nozzles comprising:

a fluid inlet, a fluid outlet, an internal channel between said fluid inlet and fluid outlet, and an internal electrode that is electrically charged to a predetermined first voltage magnitude, wherein said internal electrode is positioned proximal to said internal channel and imparts an electrical charge to at least a portion of a fluid moving through said internal channel; and an external electrode having a surface that is made of a substantially electrically conductive material, said external electrode being electrically charged to a predetermined second voltage magnitude, wherein said external electrode is positioned at an exit region of said moving fluid as the fluid passes through said fluid outlet; and (c) a separation electrode physically positioned between both said first and second banks of nozzles, said separation electrode being electrically charged to a predetermined third voltage magnitude.

2. The electrostatic nozzle apparatus as recited in claim 1, wherein said external electrode is spaced-apart from said fluid outlet.

3. The electrostatic nozzle apparatus as recited in claim 1, wherein said external electrode makes physical contact with a surface of said nozzle at a location proximal to said fluid outlet.

4. The electrostatic nozzle apparatus as recited in claim 1, wherein each nozzle includes a nozzle body that is substantially made of a material that is electrically insulative, and wherein said internal electrode is substantially made of a material that is one of: (a) electrically conductive, and (b) electrically semiconductive.

5. The electrostatic nozzle apparatus as recited in claim 4, wherein a shape of an exterior portion of said nozzle body is substantially cylindrical, and wherein said fluid exits from said nozzle through an interior region which exhibits a shape that is substantially cylindrical as an inner diameter, which shape extends from said internal electrode to said fluid outlet.

6. The electrostatic nozzle apparatus as recited in claim 4, wherein a shape of an exterior portion of said nozzle body is substantially cylindrical, and wherein said fluid exits from said nozzle through an interior region which exhibits a shape that is substantially parabolic, which shape extends from said internal electrode to said fluid outlet such that a first cross-section at said internal electrode is less than a second cross-section at said fluid outlet.

7. The electrostatic nozzle apparatus as recited in claim 1, wherein said separation electrode comprises a material that is one of: (a) substantially electrically conductive; and (b) substantially electrically semiconductive.

8. The electrostatic nozzle apparatus as recited in claim 1, wherein said fluid comprises a liquid as it flows through said internal channel to said fluid outlet, and breaks apart into a plurality of droplets upon exiting said nozzle body at said fluid outlet.

9. The electrostatic nozzle apparatus as recited in claim 1 wherein said external electrodes presence enables said nozzle to produce an effective discharge pattern when the predetermined first voltage magnitude is significantly less than would otherwise be required to produce a substantially similar discharge pattern without the presence of said external electrode.

10. An electrostatic nozzle apparatus, comprising:

(a) a first plurality of nozzles physically arranged in a first bank of nozzles;

(b) a second plurality of nozzles physically arranged in a second bank of nozzles; each nozzle in the first plurality of nozzles and the second plurality of nozzles comprising:

a fluid inlet, a fluid outlet, an internal channel between said fluid inlet and fluid outlet, and an internal electrode that is electrically charged to a predetermined first voltage magnitude, wherein said internal electrode is positioned proximal to said internal channel and imparts an electrical charge to at least a portion of a fluid moving through said internal channel; and an external electrode that is positioned at an exit region of said moving fluid as the fluid passes through said fluid outlet, and which is electrically charged to a predetermined second voltage magnitude, wherein said external electrode's presence enables said nozzle to produce an effective discharge pattern when the predetermined first voltage magnitude is in a range of 2 kV through 39 kV, inclusive, and the predetermined second voltage magnitude is in a range of 1 volt through 31 kV, inclusive; and (c) a separation electrode physically positioned between both said first and second banks of nozzles, said separation electrode being electrically charged to a predetermined third voltage magnitude.

11. The electrostatic nozzle apparatus as recited in claim 10, wherein said first voltage magnitude is in a range of 5 kV through 15 kV, inclusive, and second voltage magnitude is in a range of 1 volt through 5 kV, inclusive.

12. The electrostatic nozzle apparatus as recited in claim 10, wherein said first and second voltage magnitudes exhibit the same polarity.

13. The electrostatic nozzle apparatus as recited in claim 10, wherein said external electrode exhibits a surface that is made of a material which is at least one of: (a) substantially electrically conductive; and (b) substantially electrically semiconductive.

14. The electrostatic nozzle apparatus as recited in claim 10, wherein said external electrode is spaced-apart from said fluid outlet.

15. The electrostatic nozzle apparatus as recited in claim 10 wherein each nozzle includes a nozzle body that is substantially made of a material that is electrically insulative, and wherein said internal electrode comprises a material that is one of: (a) substantially electrically conductive, and (b) substantially electrically semiconductive.

* * * * *